United States Patent [19]

Wirtz et al.

[11] Patent Number: 4,973,218

[45] Date of Patent: Nov. 27, 1990

[54] BATTERY PLATE STACKER

[75] Inventors: John W. Wirtz; David Yanik; Robert R. Rader; Roel Mendoza; Dennis E. Essig, all of Port Huron, Mich.

[73] Assignee: Wirtz Manufacturing Company, Inc., Port Huron, Mich.

[21] Appl. No.: 367,020

[22] Filed: Jun. 16, 1989

Related U.S. Application Data

[63] Continuation-in-part of Ser. No. 209,911, Jun. 22, 1988.

[51] Int. Cl.[5] ..... B65G 57/14

[52] U.S. Cl. ..... 414/791.1; 198/576; 198/817; 414/793.5; 414/794.3

[58] Field of Search ..... 198/466.1, 817, 575, 198/576; 414/790, 790.1, 791.1, 793.3, 793.4, 793.5, 794.3

[56] References Cited

U.S. PATENT DOCUMENTS

| | | | |
|---|---|---|---|
| 2,880,850 | 4/1959 | Keathley, Sr. et al. | 198/817 X |
| 3,057,453 | 10/1962 | McAlpine et al. | 198/466.1 X |
| 4,121,723 | 10/1978 | Nellen et al. | 414/79.1 X |

OTHER PUBLICATIONS

Copies of these references were supplied during the prosecution of parent case Ser. No. 209911.

*Primary Examiner*—Robert J. Spar
*Assistant Examiner*—Janice Krizek
*Attorney, Agent, or Firm*—Barnes, Kisselle, Raisch, Choate, Whittemore & Hulbert

[57] ABSTRACT

A method and apparatus for piling in stacks a plurality of successive individual battery plates moving at a high rate of speed. Synchronized plates are transferred to a carrier conveyor which advances them into work stations with the leading edge of each plate raised generally vertically above its trailing edge. Sequentially in one and another of the stations, each plate is rapidly stopped so that a plurality of succeeding synchronized plates are each disengaged from the carrier and deposited in a stack on an elevator underlying each station. The elevator is retracted as each plate is deposited so that the next plate can be received on the stack. Periodically, the depositing of plates is switched from one station to another and stacks of plates are removed from the elevator associated with each station so that another stack can be formed on the elevator.

46 Claims, 15 Drawing Sheets

FIG. 1
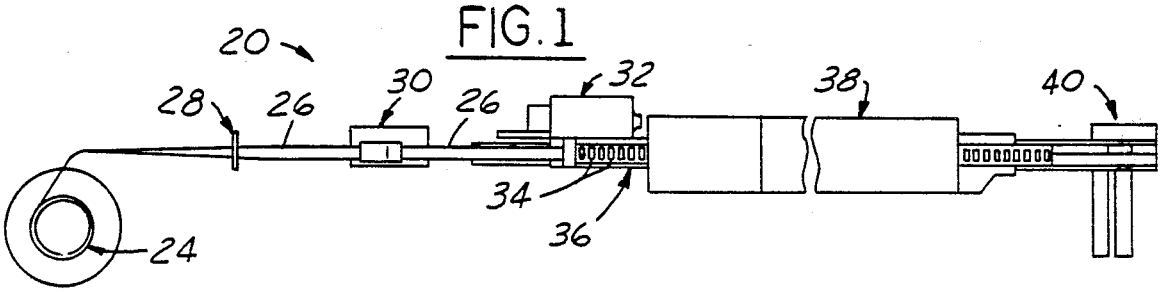
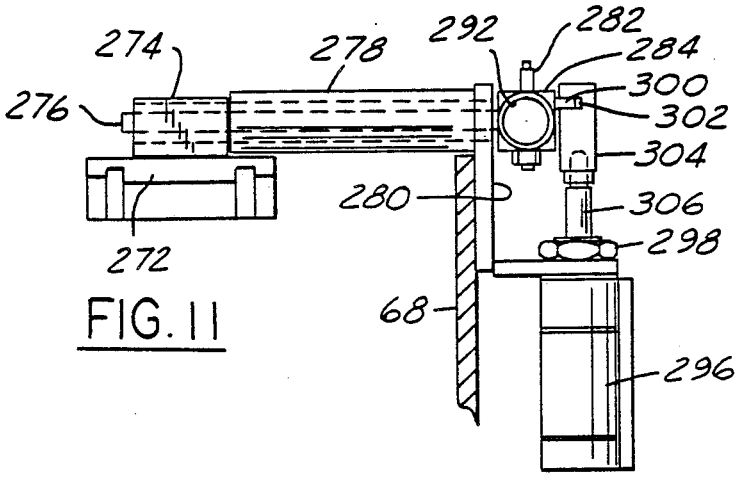
FIG. 11
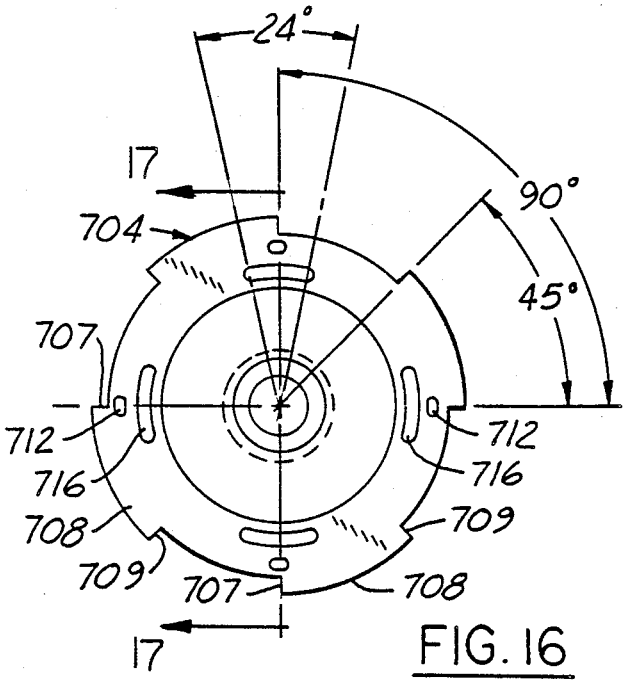
FIG. 16
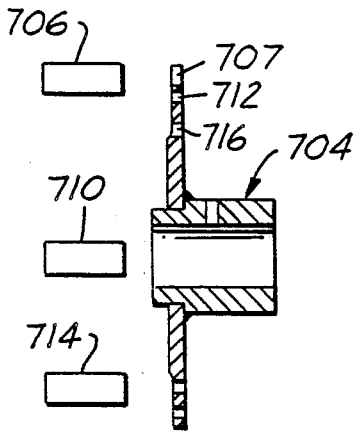
FIG. 17

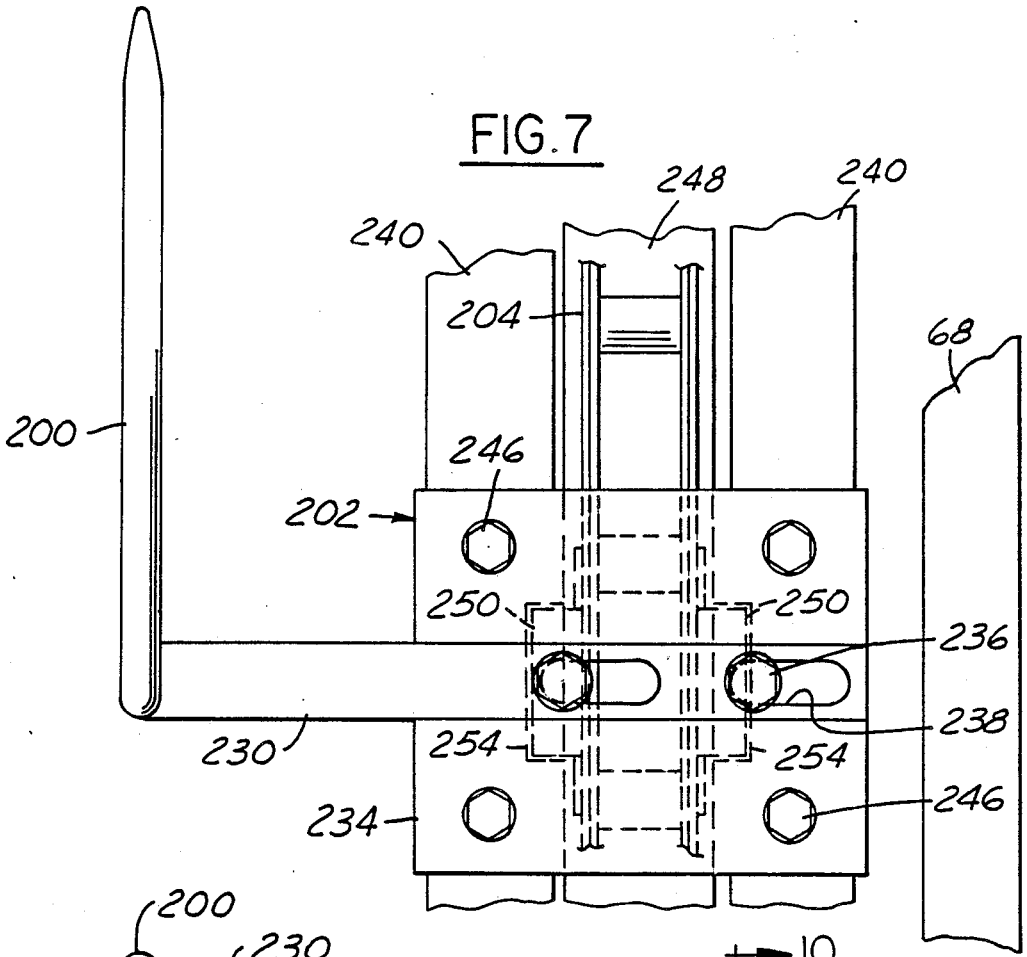
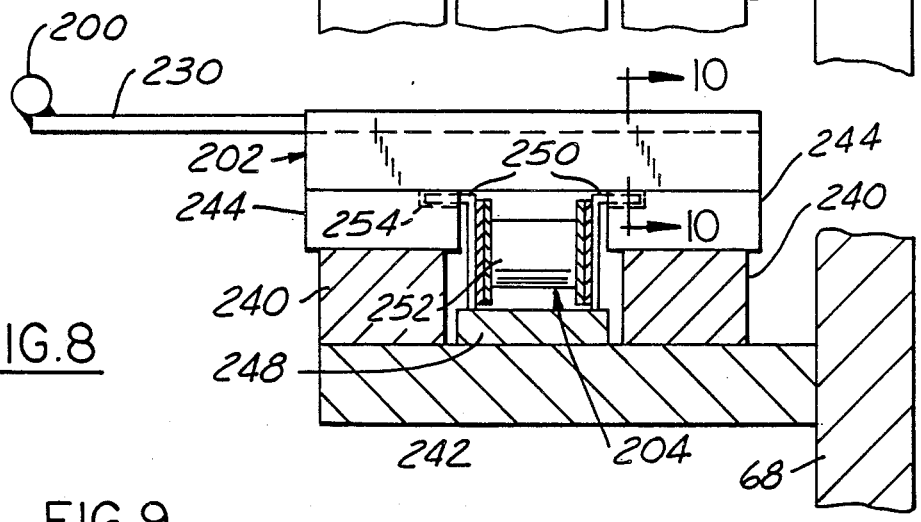
FIG.8
FIG.9
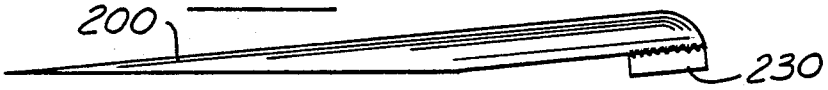
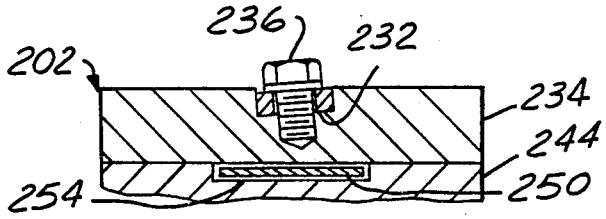
FIG.10

800
32'
38
36
26'
30
28
26
24
20'
22

36
806a
804
806b
32'
842
838
836
834
832
840
846
42
844
882
822
850
870
866
868
848
820
830
858
828
826
162
880
884
856
862
864
860
878
874
896
872
854
48
200
894
800
898
892

BATTERY PLATE STACKER

This application is a continuation-in-part of application Ser. No. 07/209,911 filed June 22, 1988.

FIELD

This invention relates to making plates for lead acid batteries and more particularly to a method and apparatus for stacking a plurality of battery plates.

BACKGROUND

Various methods and devices for making and handling battery grids and plates have been previously developed. Battery grids have sometimes been cast as a continuous web, which after casting are pasted and then severed into successive individual plates. Suitable continuous casting, pasting and cutting processes and devices are shown in U.S. Pat. No. 4,349,067; 4,606,383; and 4,583,437 and 4,543,863.

The art has developed to the point where battery grids can be cast in a continuous web, pasted and cut at a rate as high as 200 lineal feet per minute. Since each individual battery grid typically has a length along the web in the range of 4 inches to 6 inches, they can be produced at the rate of about 400 to 600 individual grids per minute.

Handling and processing battery grids and plates at this high speed is extremely difficult due to their relatively large mass, soft and flexible nature, and being loaded with uncured battery paste. Battery grids and plates are soft, flexible and easily damaged because they have an open mesh, are made of soft lead and are relatively thin with a thickness usually in the range of about 0.030 to 0.080 of an inch. Handling and processing of the grid is made more difficult by the soft and sticky nature of the uncured paste. Frequently, to facilitate handling a thin piece of paper is applied over the uncured paste on one or both sides of the grid.

SUMMARY

Pursuant to this invention, a stream of successive individual pasted grids or plates moving at a high rate of speed are continuously piled in stacks, each having a plurality of superimposed plates. Preferably, the plates are received on an entry conveyor, transferred to a moving carrier conveyor which preferably supports each plate in an inclined position with its leading edge raised above its trailing edge, and then rapidly decelerated, preferably by an energy absorbing device and disengaged from the carrier conveyor so that plates are successively gently deposited in superimposed relation in a stack received on an elevator which recedes as the plates are being deposited. Preferably, the plates are deposited alternately in one of two or more stacks each received on a separate elevator.

Preferably, an indexable conveyor is associated with each elevator to remove a completed stack of plates from the elevator so that thereafter it can receive another stack of plates. To provide proper registration and depositing of the plates, the carrier conveyor is driven in synchronized relationship with the entry conveyor. Preferably to prevent jamming and improper registration of the plates in the stacker an abort mechanism diverts improperly synchronized plates out of the stacker so that they are not received by the carrier conveyor.

Objects, features and advantages of this invention are to pile successive pasted plates moving at a high speed into a plurality of stacks rapidly, reliably, easily, substantially continuously, without damage to relatively soft and flexible plates, with proper synchronization, without jamming, and to provide an apparatus for doing so which is of relatively simple design, economical manufacture and assembly, rugged, durable, easily and automatically synchronized, highly reliable and requires relatively little maintenance and adjustment in use.

BRIEF DESCRIPTION OF THE DRAWINGS

These and other objects, features and advantages of this invention will be apparent from the following detailed description, appended claims and accompanying drawings in which:

FIG. 1 is a semi-schematic top view of a production line for battery plates with a plate stacker embodying this invention;

FIG. 7 is a fragmentary and enlarged top view of a finger and mounting block of the carrier conveyor of the stacker;

FIG. 8 is an end view of the finger and carrier block of FIG. 7;

FIG. 9 is a side view of the finger of FIG. 7;

FIG. 10 is a sectional view taken generally on line 10—10 of FIG. 8 and showing a portion of the side of the mounting block of FIG. 7;

FIG. 11 is an end view of a plate stop mechanism of the stacker;

FIG. 16 is a side view of a timing disc of the stacker which in conjunction with sensors generates signals for controlling and synchronizing the drive of the stacker;

FIG. 17 is a sectional view taken generally on line 17—17 of FIG. 16.

DETAILED DESCRIPTION

Figure 2:
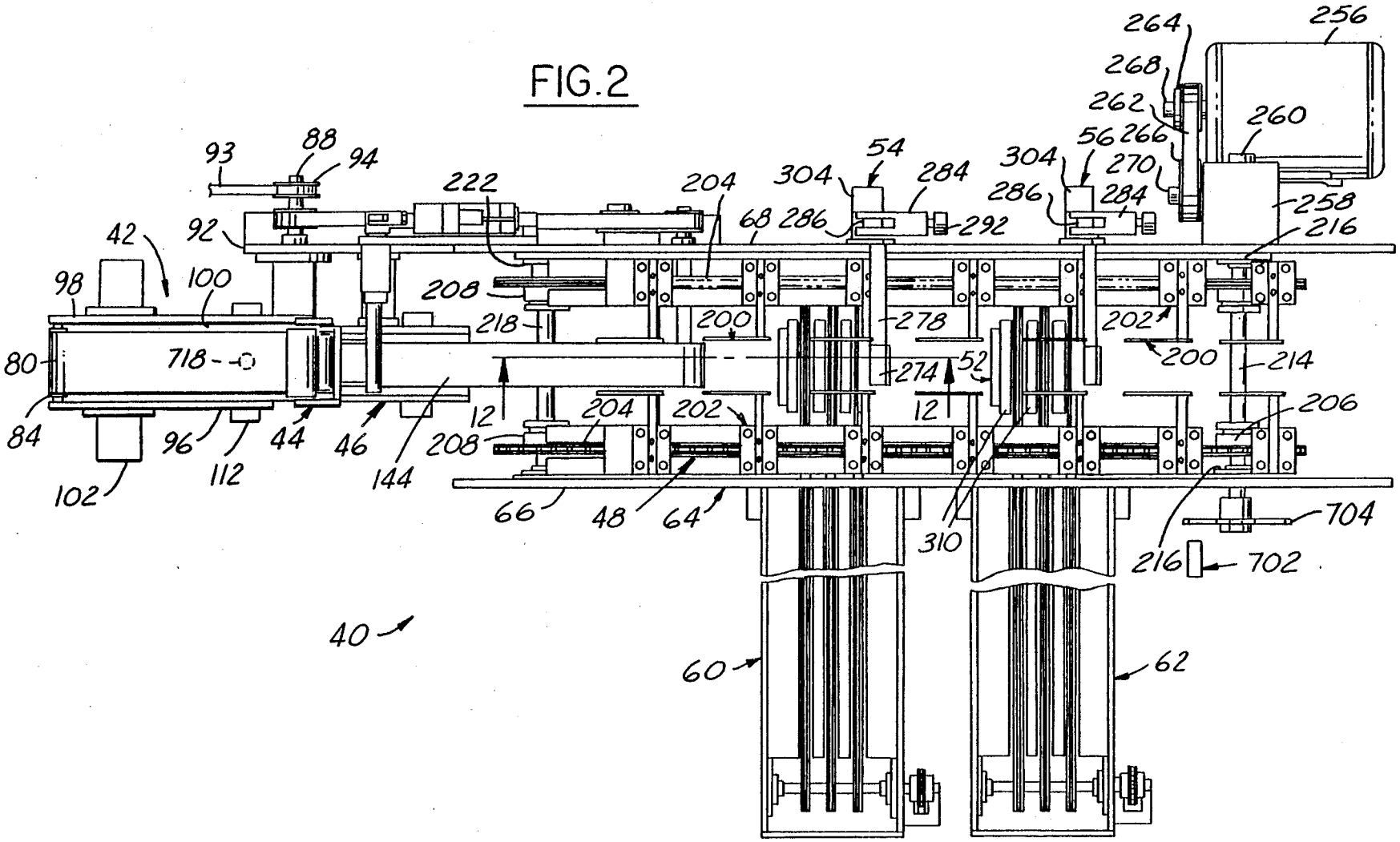
FIG. 2 is an enlarged top view of the stacker of FIG. 1.

FIG. 1 illustrates a production line 20 for battery plates which has a coiler 22 for unwinding a coil 24 of a continuous web 26 of a plurality of battery grids of lead. The web passes through a loop or take-up stand 28 and into a pasting machine 30 which applies paste to the grids of the web and preferably overpastes both faces of the web so that the grids are encased by the paste. If desired, a strip of paper can also be applied to one or both of the faces of the pasted web. Preferably, the pasting machine is of the type disclosed in U.S. Pat. No. 4,606,383, the description of which is incorporated herein by reference and hence it will not be described in further detail.

If desired, the coiler 22 and the coil 24 can be eliminated and a web of grids fed directly into the takeup stand 28 from a machine for continuously casting a web of battery grids. Suitable battery grid continuous casting machines are disclosed in U.S. Pat. Nos. 4,349,067; 4,415,016; 4,509,581; 4,534,404; and 4,544,014. The disclosures of these patents are incorporated herein by reference and hence suitable continuous casting methods and machines will not be described in further detail.

The pasted web 26' passes into a rotary cutter 32 which completely severs or cuts individual pasted battery grids or plates 34 from the web. Preferably, the rotary cutter is of the type disclosed in U.S. Pat. No. 4,583,437, the disclosure of which is incorporated herein by reference and hence will not be described in further detail.

The individual battery plates 34 are received on a conveyor 36 which preferably moves them through a flash drying oven 38. Preferably, to provide a gap or space between adjacent plates 34 to thereby decrease the risk of jamming of plates, conveyor 36 is driven at a greater lineal speed than that of the plates emerging from the cutter 32.

To facilitate further handling and processing of the pasted grids, oven 38 merely dries or removes moisture from the outer layer or skin of the paste which temporarily strengthens and solidifies the skin while the central portion of the paste remains relatively soft and pliable and retains substantial moisture. For many processing applications this flash drying is not absolutely necessary and thus for such applications this oven is optional. Typically, this is a direct flame gas fired oven which may be of conventional construction and hence will not be described in further detail.

Figure 3:
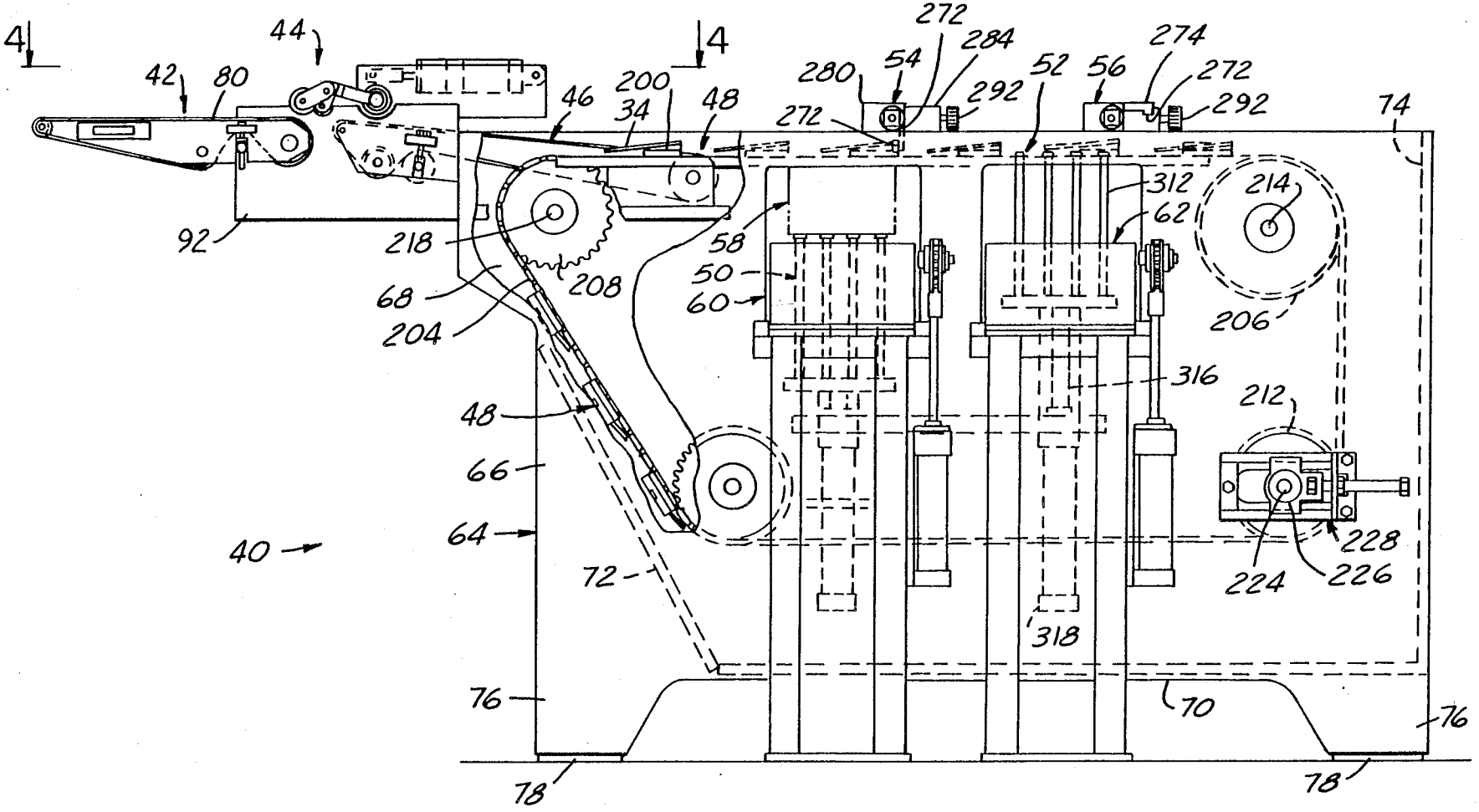
FIG. 3 is an enlarged side view with portions broken away of the stacker of FIG. 1.

As the battery plates 34 emerge from the oven, they are normally conveyed into a stacker 40 embodying this invention which piles the plates into stacks each having a plurality of plates. As shown in FIGS. 2 and 3, the stacker has an entry conveyor 42. Each plate emerging from the entry conveyor is either diverted from the stacker by an abort mechanism 44 shown in its inoperative position in FIG. 3 or passes onto a transfer conveyor 46 from which it is picked up by a carrier conveyor 48 and advanced over an underlying elevator 50 or 52.

In normal operation, the plates are caused to pile up in a stack on one and then the other of the elevators by an associated stop mechanism 54 or 56. When energized, each stop mechanism stops the forward movement of the plates directly over its associated elevator so that the advancing carrier conveyor disengages from the plates and they are deposited or piled in a stack on the elevator. As each plate is deposited the elevator recedes or retracts so that the next plate can be received on the stack. When the stack reaches a predetermined height, its associated stop mechanism is released and the other stop mechanism is energized to pile a stack of plates on the other elevator.

After each stack of plates is completed it is deposited by the elevator on an associated stack conveyor 60 or 62 which is indexed to remove the stack of plates from the elevator. Thereafter, the elevator is raised so that another stack of plates can be formed on it. The stacks may be removed from the conveyors 60 and 62, either manually or by a pick up and transfer mechanism not shown.

Stacker Frame

As shown in FIGS. 2 and 3, the stacker 40 has a main frame 64 with a pair of side plates 66 and 68 which are generally parallel and laterally spaced apart. A bottom plate 70 and end plates 72 and 74 are received between and bolted to the side plates. The side plates have leg portions 76 which bear on and are welded to base mounting plates 78.

Entry Conveyor

Figure 4:
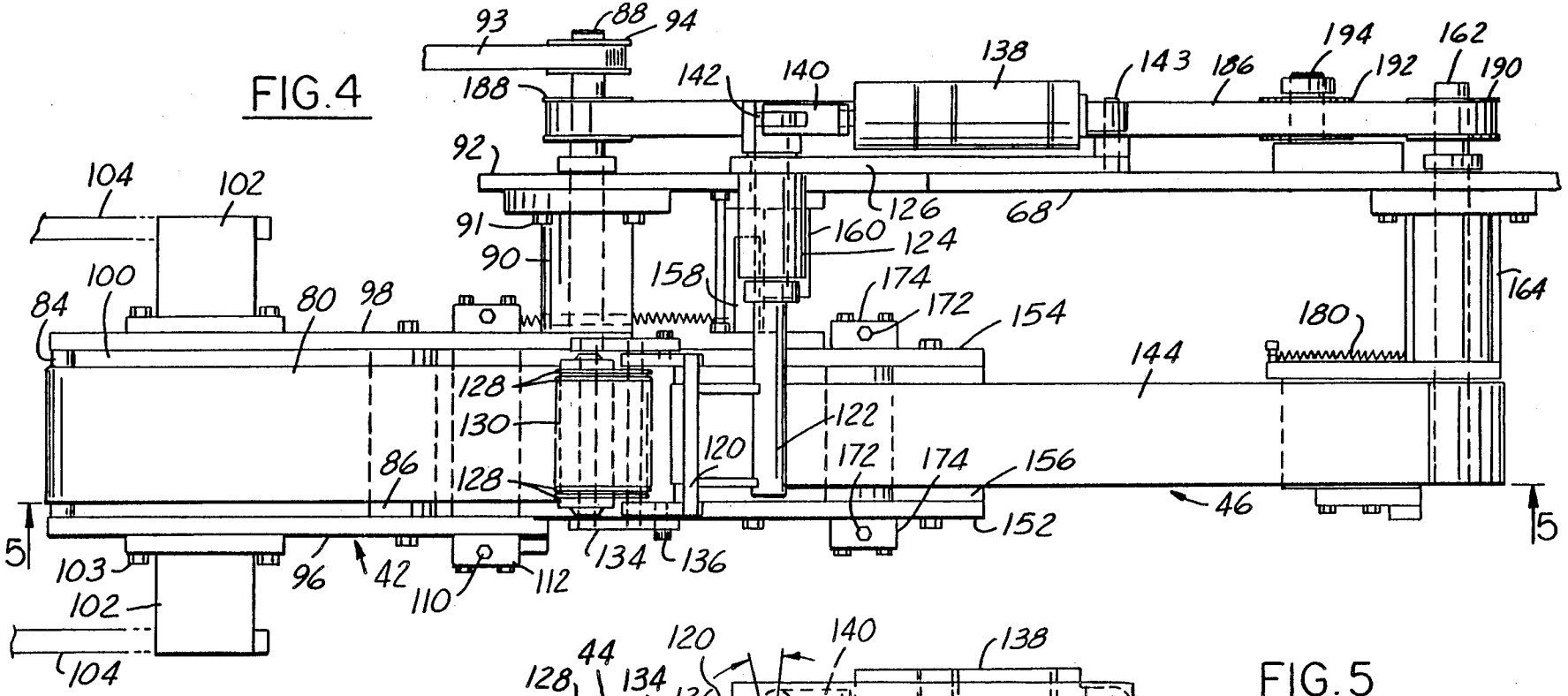
FIG. 4 is an enlarged and fragmentary top view of a portion of the stacker taken in the direction of the arrows 4—4 in FIG. 3.
Figure 5:
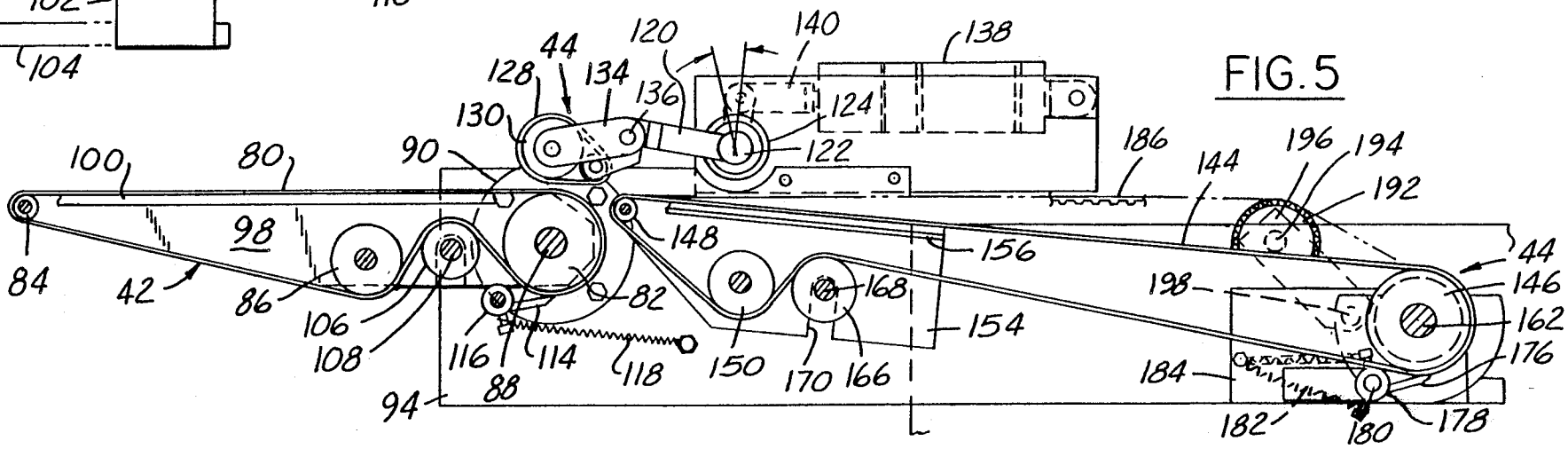
FIG. 5 is a sectional view taken generally on line 5—5 of FIG. 4 showing a plate abort mechanism in its inoperative position.

As shown in FIGS. 4 and 5, the entry conveyor 42 has an endless belt 80, preferably of nitrile coated polyester cord outer face, received on a drive roller 82 and idler rollers 84 and 86. The drive roller is keyed to a driven shaft 88 journalled for rotation in a housing 90 secured by bolts 91 to a mounting plate 92 secured by bolts to the side plate 68. In normal operation, the entry conveyor is driven by the oven conveyor through a timing belt 93 (FIG. 2) received on a cog pulley 94 keyed to the shaft 88.

The idler rollers 84 and 86 are journalled for rotation and carried by a pair of plates 96 and 98 secured to the edges of a belt support plate 100. The carrier plate 98 is secured to the housing 90. When in operative relationship with the oven conveyor, the entry conveyor 42 is also supported by mounting brackets 102 (FIG. 4) secured by bolts 103 to the plates 96 and 98 and connected to supports 104 fixed to the oven conveyor adjacent its discharge end.

The endless belt 80 is tensioned by an idler roller 106 (FIG. 5) journalled for rotation on a shaft 108. To vary and adjust the belt tension, the roller is movable generally transversely by turning bolts 110 threaded through the shaft 108 and captured in blocks 112 secured to the plates 96 and 98. Paste and other debris is removed from the belt by a scraper blade 114 received in a holder 116 pivotally mounted on the carrier plates 96 and 98 and yieldably biased into engagement with the belt by a tension spring 118.

Abort Mechanism

Figure 6:
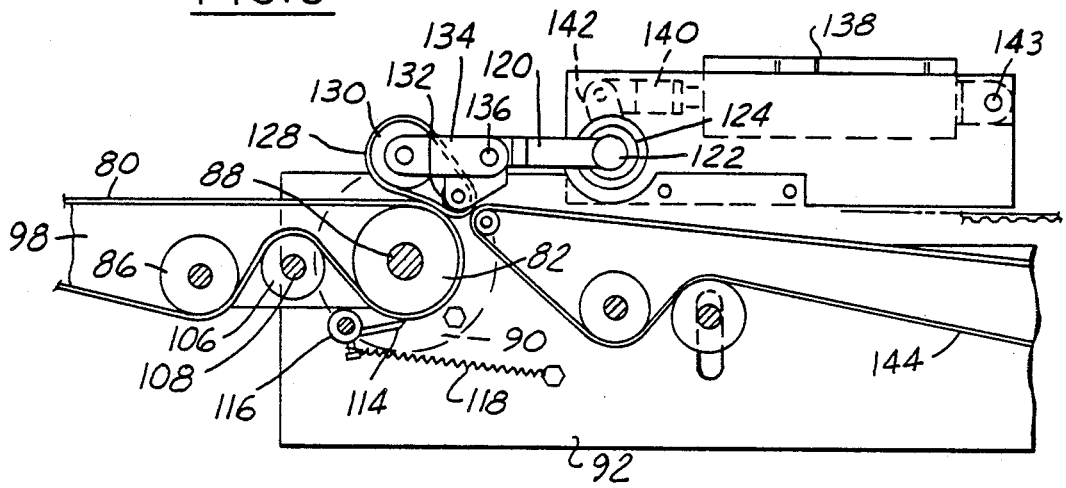
FIG. 6 is a fragmentary sectional view similar to FIG. 5 showing the plate abort mechanism in its operative position.

The abort mechanism 44 has a U-shaped mounting bracket 120 fixed to an actuator shaft 122 journalled for rotation in a housing 124 fixed to a support plate 126 secured to the mounting plate 92. Flexible endless belts are provided by O-rings 128 received in grooves in a pair of idler rollers 130 and 132. The small idler roller 132 is journalled for rotation and mounted on the bracket 120 for movement therewith. The large idler roller 130 is journalled for rotation on a pair of links 134 which are pivotally mounted by a shoulder screw 136 on the bracket 120 for movement relative thereto. The abort mechanism is pivotally moved to its inoperable and operable or raised and lowered positions (as shown in FIGS. 5 and 6), by a pneumatic cylinder 138 with its piston rod pivotally connected by a clevis 140 to the free end of a lever arm 142 fixed to the actuator shaft 122. The casing of the cylinder is pivotally connected by a stud 143 to the support plate 126.

When the abort mechanism 44 is in the raised or inoperative position, there is sufficient clearance for the plates to pass under the rollers without contacting them. As shown in FIG. 6, when the abort mechanism is in its lowered or operative position, the belts 128 carried by rollers 130 and 132 bear on each plate as it approaches the exit end of the entry conveyor 42 and deflect the plate downwardly away from the transfer conveyor 46 so that it drops out of the stacker, and preferably into an underlying container. Preferably, to enchance the ability of the abort mechanism to deflect plates out of the stacker, its belts 128 are driven by frictional contact with the belt 80 of the entry conveyor 42.

Transfer Conveyor

As shown in FIG. 5, the transfer conveyor has a flexible endless belt 144, preferably of nitrile coated polyester cord, received over a drive roller 146 and a pair of idler rollers 148 and 150. The upper run of the belt 144 could extend horizontally. However, to facilitate picking up plates from the belt, preferably its upper run is inclined or sloped downwardly at an acute included angle which is desirably in the range of about 2° to 15°, and preferably about 3° to 10°. The idler rollers 148 and 150 are journalled for rotation and mounted on a pair of carrier plates 152 and 154 secured to the edges of a spacer plate 156. The conveyor is supported by brackets 158 and 160 connected together and to the mounting plate 92 and carrier plate 154. The drive roller is keyed to a driven shaft 162 journalled for rotation in a housing 164 secured to the side plate 68.

The belt is tensioned by an idler roller 166 journalled for rotation on a shaft 168 received in slots 170 in the carrier plates. To vary and adjust the belt tension, bolts 172 are threaded through the shaft 168 and received in blocks 174 secured to the carrier plates 152 and 154. Paste and other debris is removed from the belt by a scraper blade 176 received in a holder 178 pivoted on a shaft 180 and yieldably biased by a tension spring 182 into engagement with the belt. The shaft 180 is fixed to a plate 184 secured to the housing 164.

The belts 80 and 144 of the entry and transfer conveyors are driven in synchronized relationship at the same lineal surface speed through a timing belt 186 received on cog pulleys 188 and 190 keyed to their associated shafts 88 and 162. The timing belt is tensioned by an idler pulley 192 journalled for rotation on a stub shaft 194 fixed to the free end of a movable lever arm 196 which pivots on and is secured in adjusted position to the mounting plate by cap screws 198.

Carrier Conveyor

Figure 12:
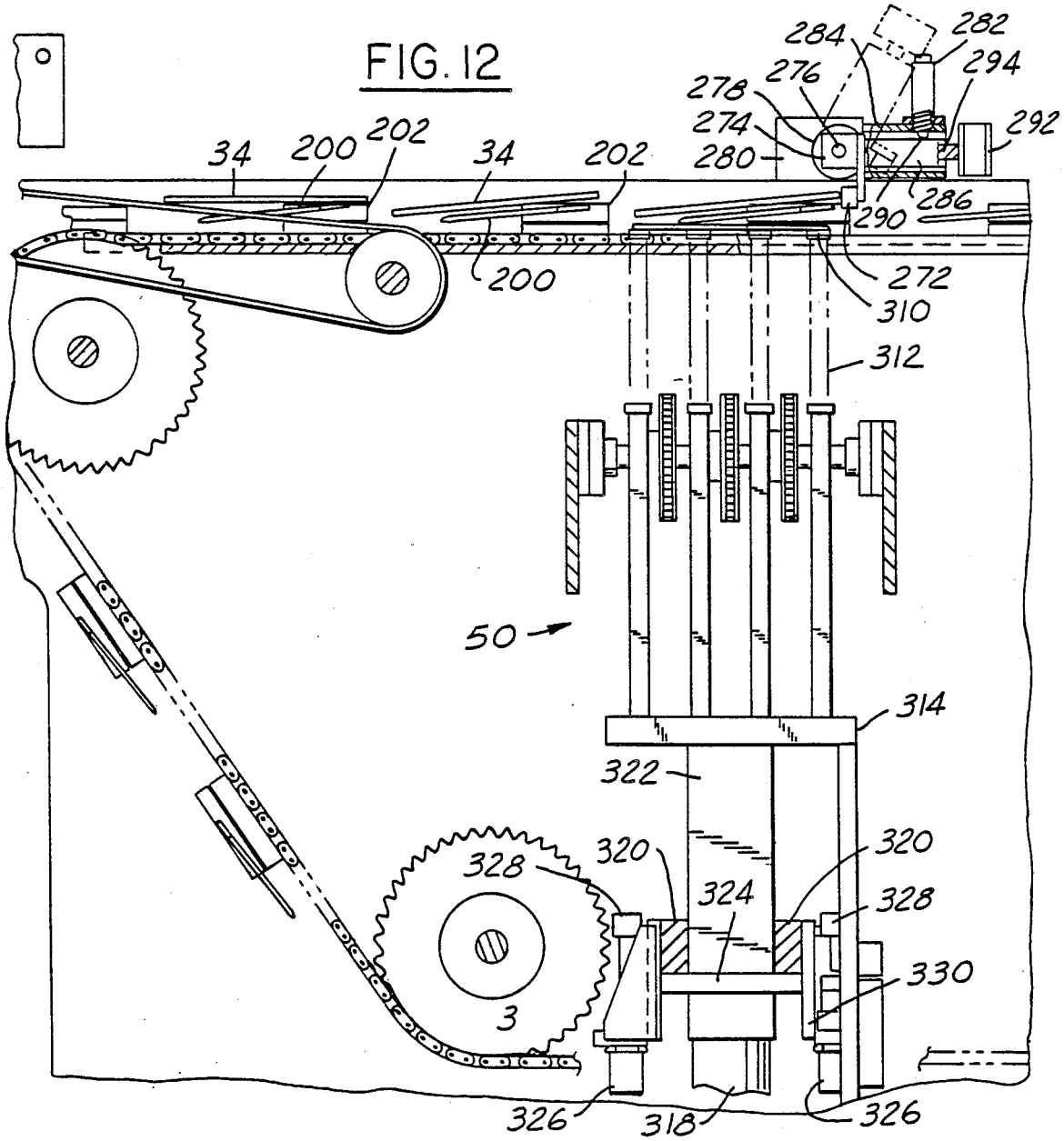
FIG. 12 is an enlarged and fragmentary sectional view taken generally on line 12—12 of FIG. 2 and illustrating an elevator and plate stop mechanism of the stacker.

As shown in FIGS. 2 and 12 each battery plate 34 is picked up from the transfer conveyor by a pair of spaced apart and cantilevered fingers 200 of the carrier conveyor. Each finger is secured to a carrier block 202 driven around a closed loop by one of a pair of endless chains 204, each received on one of a pair of drive sprockets 206 (FIG. 3) and three pairs of idler sprockets 208, 210 and 212. The drive sprockets are keyed to a driven shaft 214 journalled for rotation by bearings 216 mounted on the side plates 66 and 68 of the frame. Each pair of idler sprockets 208 and 210 is keyed to a shaft 218 and 220, respectively, journalled for rotation by bearings 222 mounted on the side plates. To tension the chains, the pair of idler sprockets 212 are keyed to a shaft 224 journalled by bearing 226 received in adjustable slide mechanisms 228 mounted on the side plates.

As shown in FIGS. 7–10, each finger 200 is fixed to one end of a bar 230 slidably receivable in a groove 232 in a top plate 234 of the carrier block 202 and secured in adjusted position by a pair of cap screws 236 threaded into the plate and received in elongate slots 238 in the bar. To stabilize and minimize vibration of the fingers 200 while they are moving a battery plate, each block 202 slides on a pair of underlying longitudinal rails 240 secured to mounting cross bars 242 each fixed to one side of the frame. Preferably, a pair of laterally spaced apart wear blocks 244 are secured by cap screws 246 to the top plate and bear on the rails. Along its upper run, preferably, each chain slides on and is supported by a bar 248 secured to the cross bars 242. To minimize the transmission of vibration from the chains 204, each block 202 is drivingly connected to its associated chain by loosely capturing a pair of opposed tabs 250 on a link 252 of the chain in recesses 254 in the wear blocks which recesses are somewhat larger than the tabs.

To facilitate the stopping and stacking of plates, preferably each finger 200 is inclined or sloped so that when it approaches the stop mechanisms 54 and 56 its leading end is vertically above its trailing end and its trailing end is vertically below the leading end of the immediately succeeding finger. Preferably, each finger is inclined to its path of travel at an acute included angle which is desirably in the range of 2° to 15° and preferably about 3° to 10°.

As shown in FIG. 2, the carrier conveyor is driven by a variable speed electric motor 256 through a right angle gear box 258 with its output shaft 260 connected to the drive shaft of the carrier conveyor. The motor is connected to the gear box by a timing belt 262 received on cog pulleys 264 and 266 keyed to the motor output shaft 268 and gear box input shaft 270. In normal operation, the fingers 200 of the carrier conveyor are driven in synchronization with and at substantially the same lineal speed as that of the belt 144 of the transfer conveyor by the drive motor 256.

Plate Stops

Figure 13:
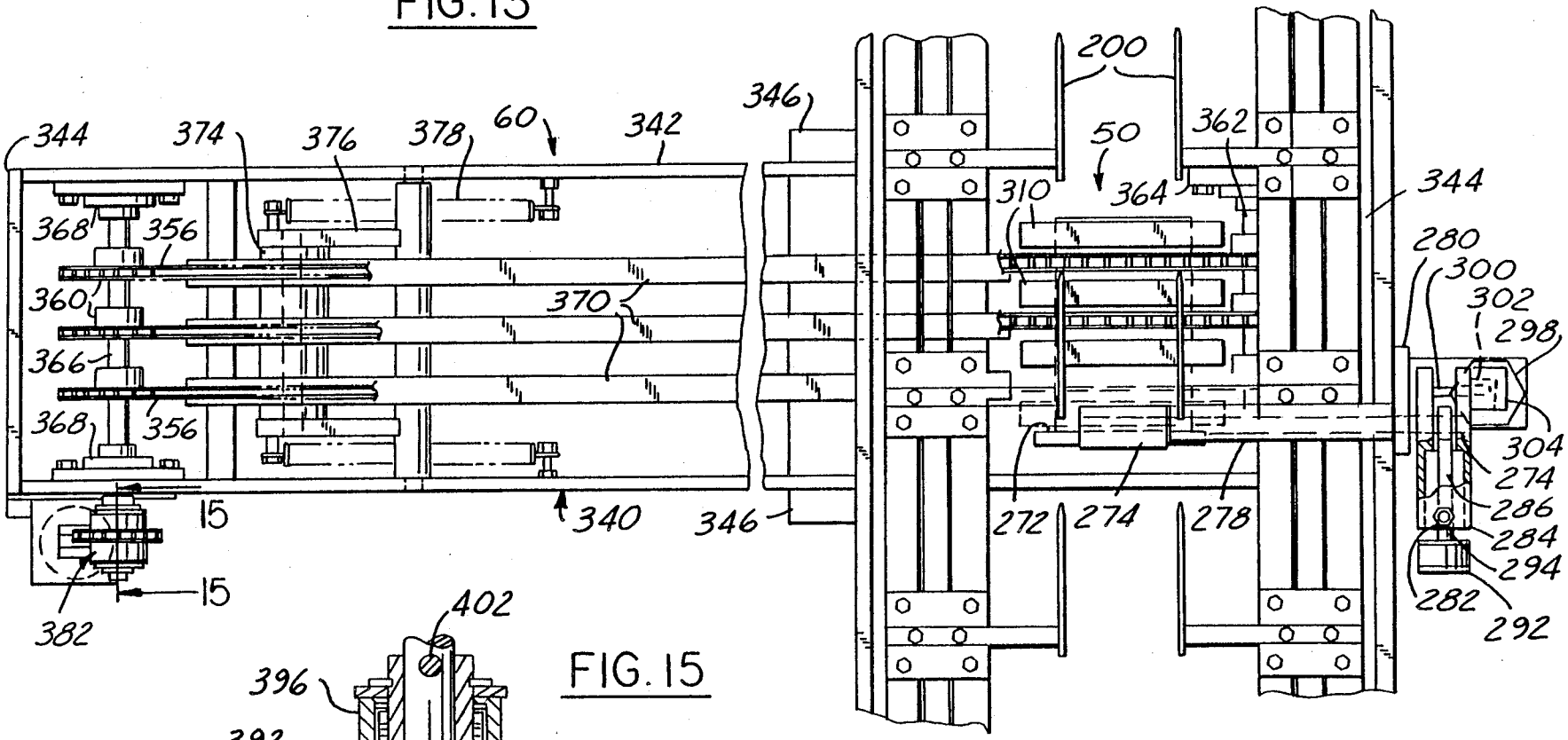
FIG. 13 is a fragmentary and enlarged top view of the stacker illustrating an elevator and associated stack conveyor of the stacker.

Preferably, the plate stop mechanisms 54 and 56 are of the same construction. As shown in FIGS. 11–13, each mechanism has a stop pad 272 secured to a mounting block 274 connected to an actuator shaft 276 journalled for rotation in a sleeve 278 fixed to a mounting bracket 280 secured to the side plate 68. Preferably, each stop pad 272 is of a somewhat flexible and energy absorbing and dissipating material, such as energy absorbing rubber, with a duromoter in the range of 40 to 70 on the Shore A Scale. When a battery plate 34 strikes the pad, energy is also absorbed and dissipated by a shock absorber 282 secured to a housing block 284 journalled on the shaft 276 for rotation relative to it. The shock absorber is operably coupled to the shaft by a lever arm 286 fixed to the shaft 276 for rotation therewith and disposed under an actuating plunger 290 of the shock absorber. A suitable shock absorber is commercially available from Endine, Inc. of 7 Center Drive, Orchard Park, N.Y. 14127, as Model No. TK 21-1.

The pad 272 is yieldably urged toward its fully lowered position by an adjustable counterweight 292 with a stud 294 threaded into the end of the lever arm 286 to permit the magnitude of its biasing torque or force to be varied and adjusted. The inertia of this counterweight also helps to decelerate the battery plate gently enough to avoid damaging it while still permitting sufficiently rapid deceleration for the stacker to operate at high speeds. The stop pad is rotated to operative and inoperative positions, shown in solid and phantom lines in FIG. 12, by a pneumatic cylinder 296 with its body secured to the mounting bracket 280 by a nut 298. The cylinder is operably connected to the stop mechanism by a pin 300 pressed into the housing block 284 and projecting into a recess 302 in a clevice 304 secured to the piston rod 306 of the cylinder.

If desired, the last or furthest downstream stop mechanism 56 could be constructed so that its pad 272 always stays in the operative position. This would permit elimination of the actuator cylinder and associated electropneumatic control circuitry. If the actuator cylinder is eliminated, the housing block 284 can be secured to the bracket 280.

Elevators

Figure 14:
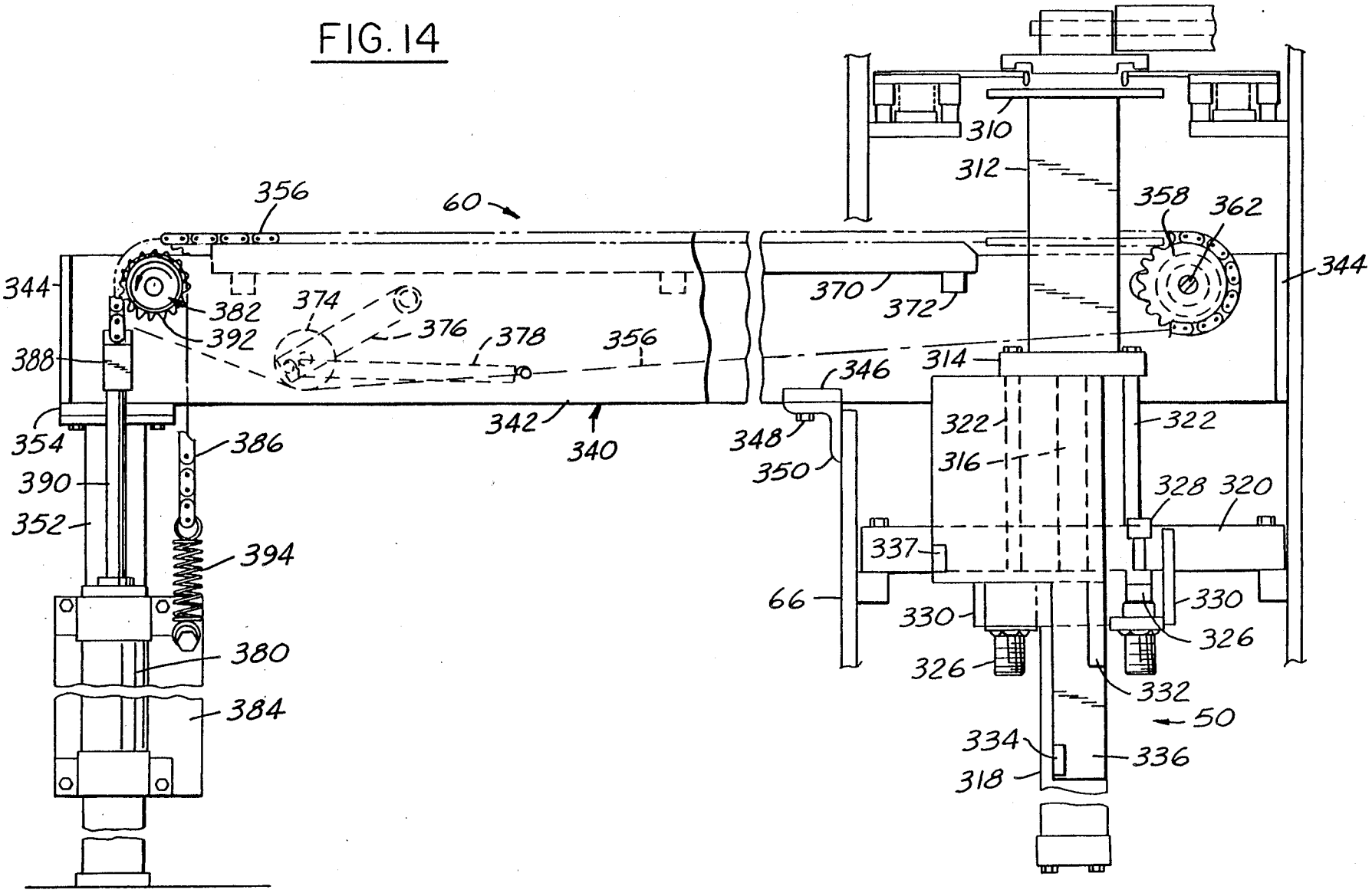
FIG. 14 is a side view with portions broken away and in section of the elevator and associated stack conveyor of FIG. 13.

The elevators 50 and 52 are of the same construction. As shown in FIGS. 12–14, each elevator has four battery plate support pads 310, each secured to the upper end of a riser 312, the lower end of which is fixed to a platform 314 secured to a piston rod 316 of a hydraulic drive cylinder 318. The cylinder is mounted on a pair of cross bars 320 secured to the side walls of the frame. Proper alignment of the pads and risers is maintained by a pair of guide plates 322 slidably received between the cross bars and secured at their upper ends to the platform. The extent to which the elevator can be raised is limited by stop bars 324 secured to the lower ends of the guide plates and underlying the cross bars. As the elevator is fully lowered, it is cushioned by a pair of shock absorbers 326 with plungers 328 which are depressed by the platform. The shock absorbers are received in mounting brackets 330 secured to the cross bars.

To indicate when the elevator is fully raised and fully lowered, a pair of limit switches (not shown), are tripped by dogs 332 and 334 respectively mounted on a carrier arm 336 with its upper end secured to the platform for movement therewith. To indicate when the stack has been completed and initiate rapid lowering of the elevator, a third limit switch (not shown) is tripped by a dog 337.

Plate Stack Conveyors

The plate stack removal conveyors 60 and 62 are the of the same construction and as shown in FIGS. 13 and 14 each has a generally box-like frame 340 with a pair of side plates 342 fixed in parallel spaced apart relationship by welds to end plates 344. Each conveyor frame is connected by tabs 346 and cap screws 348 to an angle iron bracket 350 fixed to the side plate 66 of the main frame. The outboard end of the conveyor frame is supported by a pair of upstanding legs 352 secured to a plate 354 fixed to the frame.

The stacks of battery plates are carried on the upper runs of three laterally spaced apart continuous chains 356 each received on spaced apart idler and drive sprockets 358 and 360. The idler sprockets 358 are secured to a shaft 362 journalled for rotation by bearings 364 secured to the sides 342 of the frame. The driven sprockets 360 are keyed to a shaft 366 journalled for rotation in bearings 368 secured to the sides of the frame. The upper run of each chain slides on and is supported by an underlying bar 370 secured to cross supports 372 fixed to the frame. The chains are tensioned by an idler roller 374 journalled for rotation in a generally U-shaped bracket 376 pivotally carried by the sides of the frame and yieldably biased into engagement with the chain by a pair of tension springs 378.

The chains 356 are intermittently driven in unison by a hydraulic cylinder 380 through a one-way clutch 382 to index or advance the stacks and carry them away from the associated elevator. The cylinder is mounted on a carrier plate 384 fixed to a leg. The cylinder is operably connected to the clutch 382 through a drive chain 386 which is connected at one end by a block to the piston rod 390, received on a drive sprocket 392 and connected at its other end to a return tension spring 394.

Figure 15:
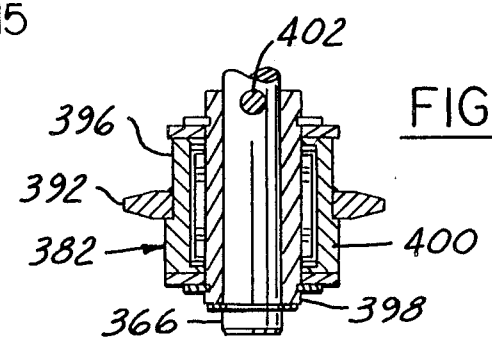
FIG. 15 is an enlarged and fragmentary sectional view taken generally on line 15—15 of FIG. 13 and illustrating a portion of the drive mechanism of the stack conveyor.

As shown in FIG. 15, the clutch has a hub 396, journalled on a sleeve 398 by a bearing 400, which when rotated in one direction (counterclockwise in FIG. 14) locks and in the opposite direction (clockwise) releases. The drive sprocket 392 is fixed to the hub 396 and the sleeve 398 is fixed to the driven shaft 366 by a cross pin 402. Thus, as the piston rod 390 of the cylinder is retracted the driven shaft 366 and conveyor chains are rotated counterclockwise to advance the stacks of battery plates and as the piston rod is advanced the conveyor chains are not driven or rotated. Therefore, the conveyor chains are advanced or indexed each time the piston rod is retracted and do not move on the return stroke as the piston rod is advanced.

Timing Wheel and Control Circuitry

Electronic signals for varying and controlling the speed of the drive motor 256 to synchronize or time the movement of the fingers 200 of the carrier conveyor with moving plates on the entry conveyor 42, are generated by the cooperation of a timing coder wheel or disc 704 (FIGS. 2 and 16–17) and associated detectors 702 (FIG. 2). The coder wheel is fixed to the carrier conveyor drive shaft 214 for rotation therewith and is driven by the motor 256.

Figure 18:
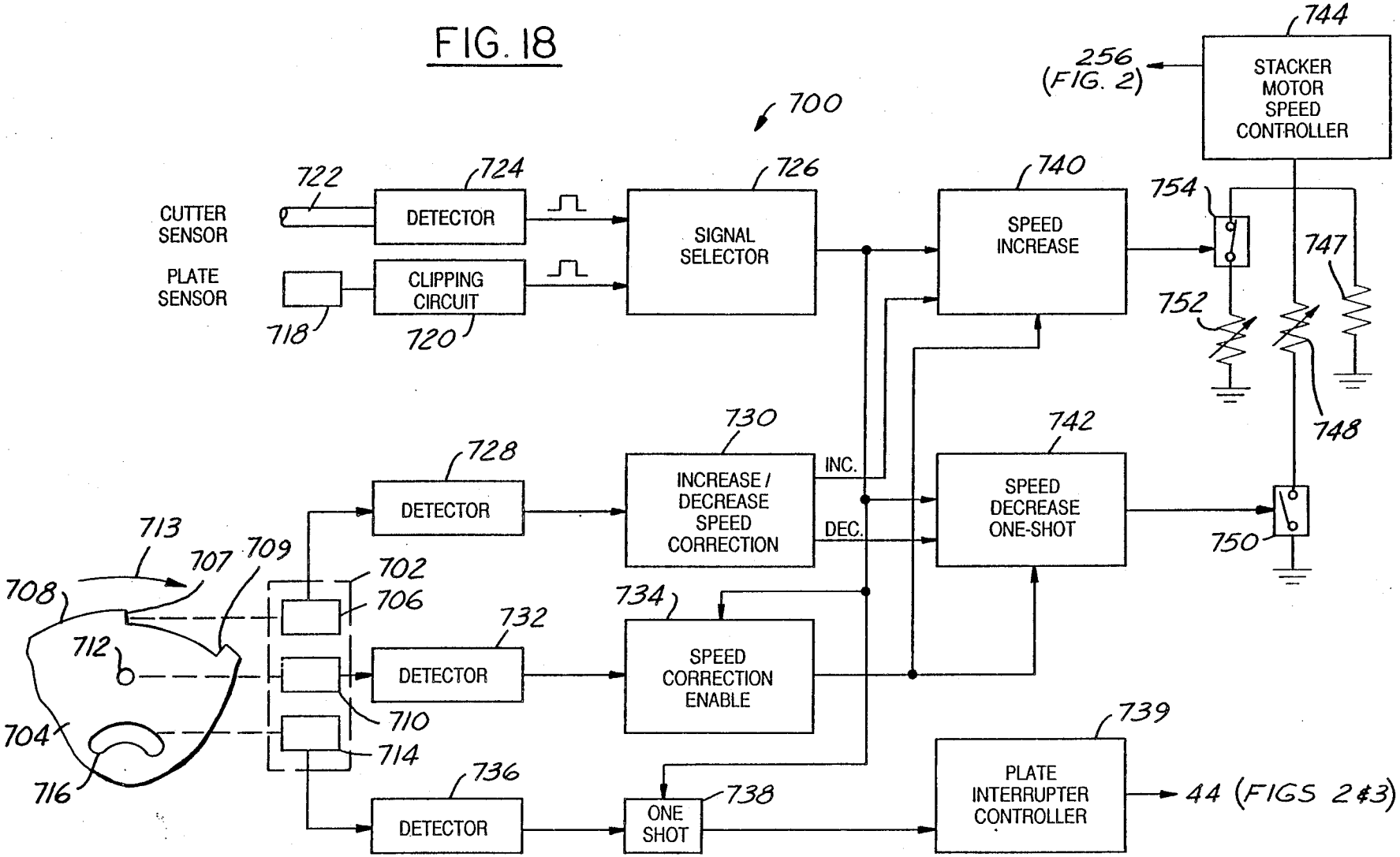
FIG. 18 is a block diagram of electronic circuits for synchronizing the drive of the stacker.

FIG. 18 is a functional block diagram of stacker motor speed control electronics 700 in accordance with a presently preferred embodiment of the invention. An electro-optical sensor assembly 702 (FIGS. 2 and 18) is positioned adjacent to timing disc 704 (FIGS. 2 and 16–18), and includes a first sensor 706 positioned in alignment with the periphery of disc 704 to detect the leading and trailing edges 707,709 of teeth 708 (assuming the direction of rotation 713). A second sensor 710 is positioned to detect the arcuate slots or apertures 712, and a third sensor 714 is positioned to detect the arcuate slots or apertures 716. Teeth 708 are preferably positioned at 90° increments, and preferably have an angular dimension of 45° between edges 707,709. Each aperture 716 is radially centered and aligned with one edge 707 of each tooth 708 and preferably has an arcuate extent of about 24°. Each aperture 712 is preferably positioned between an aperture 716 and an edge 707 and in radial alignment therewith. Apertures 712 have an arcuate extent which is less than that of apertures 716, and preferably about 2°.

Preferably, but not necessarily, each edge 707 and associated aperture 712 and aperture 716 on the wheel 704 corresponds to one set of fingers 200 of the carrier conveyor, so that one complete revolution of the wheel represents movement of four sets of fingers past a fixed reference point on the upper run of the carrier conveyor. Sensors 706, 710, 714 in a presently preferred embodiment of the invention comprise reflection-type sensors marketed by Skan-A-Matic, although transmission-type sensors and, indeed, non-optical sensors may be readily employed without departing from the principles of the present invention, as will become apparent from the following description.

A sensor 718 (FIGS. 2 and 18) is positioned along entry conveyor 42 for detecting passage of battery plates therepast and for providing a corresponding signal to a signal conditioning or clipping circuit 720. In a preferred embodiment of the invention, sensor 718 comprises an inductive proximity sensor positioned with respect to the path of battery plates along conveyor 42 so as to receive and detect passage of a battery plate edge. A further sensor (not shown) is positioned at cutter 30 (FIG. 1) and provides a signal through a fiber optic 722 to optical detection electronic 724 indicating approach of a cutter blade to a grid-severing position. See U.S. Pat. No. 4,543,863 referenced above. Detector 724 and clipping circuit 720 provide respective pulsed outputs to a signal selector 726 for selecting between the respective input signals to indicate motion of battery plates on entry conveyor 42 to which motion the carrier conveyor 48 is to be synchronized.

The output of sensor 706, which is a pulsed periodic signal which follows the leading and trailing edges 707,709 of teeth 708, is fed through detector electronics 728 to a circuit 730 for selecting between increasing and decreasing stacker motor speed adjustment in a correction mode of operation. The output of sensor 710, which is also a pulsed periodic signal controlled by slots 712, is fed through detector electronics 732 to a circuit 734 for enabling the stacker motor speed correction mode of operation. The pulsed periodic output of sensor 714 controlled by slots 716 is fed through detector electronics 736 to a one-shot 738. Speed correction enabling circuit 734 and one-shot 738 also receive inputs from signal selector 726. The output from one-shot 738 is fed to a controller 739 for operating the plate abort mechanism or interrupter 44 (FIGS. 2 and 3).

A circuit 740 for increasing motor speed during a correction mode of operation receives a first input from signal selector 726, a second input from increase/decrease speed correction electronics 730 indicative of need for a speed-increase adjustment, and an enabling input from correction enable electronics 734. Likewise, a speed-decrease circuit 742 receives a first input from signal selector 726, a second input from speed correction electronics 730 indicating need for a speed-decrease adjustment, and an enabling input from correction enable electronics 734. A speed controller 744 for stacker motor 256 (FIG. 2) in accordance with a presently preferred embodiment of the invention is of a type which controls motor speed as an inverse function of input speed command current. Such speed control is implemented in accordance with the presently preferred embodiment of the invention by connecting the controller command input to electrical power through the parallel combination of a resistor 747, a resistor 748 in series with a controlled electronic switch 750, and a resistor 752 in series with a controlled electronic switch 754. Switch 754 is normally closed and has its control input connected to speed-increase circuit 740. Switch 750 is normally open and has its control input connected to speed-decrease circuit 742.

In general operation, cutter sensor optic 722 and detector 724 are employed during initial set-up of production line 20 (FIG. 1) to initiate synchronization of motor 256 and stacker 40 to battery plates on the production line before battery plates are available on entry conveyor 42. As soon as plates are available on the latter for detection at plate sensor 718, signal selector 726 is set to respond to plate sensor 718. Such signal selection may be accomplished either manually (switch 726 in FIG. 19A) or automatically as soon as pulses from sensor 718 and clipper 720 become available. In the remaining discussion of operation, it will be assumed that selector 726 is set to respond to pulses from sensor 718.

Plate sensor 718 is positioned lengthwise of entry conveyor 42 so that receipt of a plate sensor signal, and simultaneous detection of an edge 707 at sensor 706, represents exact synchronization of motor 256 and stacker 40 to battery plates carried on conveyor 42. If the plate sensor signal is received when sensor 706 detects a tooth 708—i.e., after passage of edge 707 in the direction 713—need for a speed-decrease adjustment is indicated. On the other hand, if the plate sensor signal is received when sensor 706 is between teeth 708—i.e., between edges 707,709—need for a speed-increase adjustment is indicated. In order to prevent hunting of the motor controller when there is only a small phase difference between sensor 718 and edge 707, speed correction is enabled by circuit 734 only when sensor 710 is not adjacent to slot 712 when the plate sensor signal is received—i.e., speed correction is disabled if sensor 710 detects slot 712 when the plate sensor signal is received.

When speed correction is enabled at circuit 734 and need for a speed increase is indicated at circuit 730, switch 754 is opened by circuit 740, removing resistor 752 from parallel connection with resistor 747 and thereby decreasing the speed command current to controller 744. Stacker motor speed increases accordingly. On the other hand, when speed correction is enabled and need for a speed decrease is indicated, switch 750 is closed by circuit 742, thereby adding resistor 748 to the parallel combination of resistors 747, 752 and increasing the speed command current. Stacker motor speed decreases accordingly.

When the plate sensor signal is so far out of phase with timing disc edge 707 that the former is received outside of the timing window of disc aperture 716, plate interrupter controller 739 is activated for the time duration of one-shot 738. It will be noted, however, that speed correction is undertaken even when grid plates are diverted from the stacker, so that the entry conveyor and stacker assembly will eventually become sufficiently synchronized that plate interrupter controller 739 may be deactivated and the stacking operation may continue.

Figure 19A:
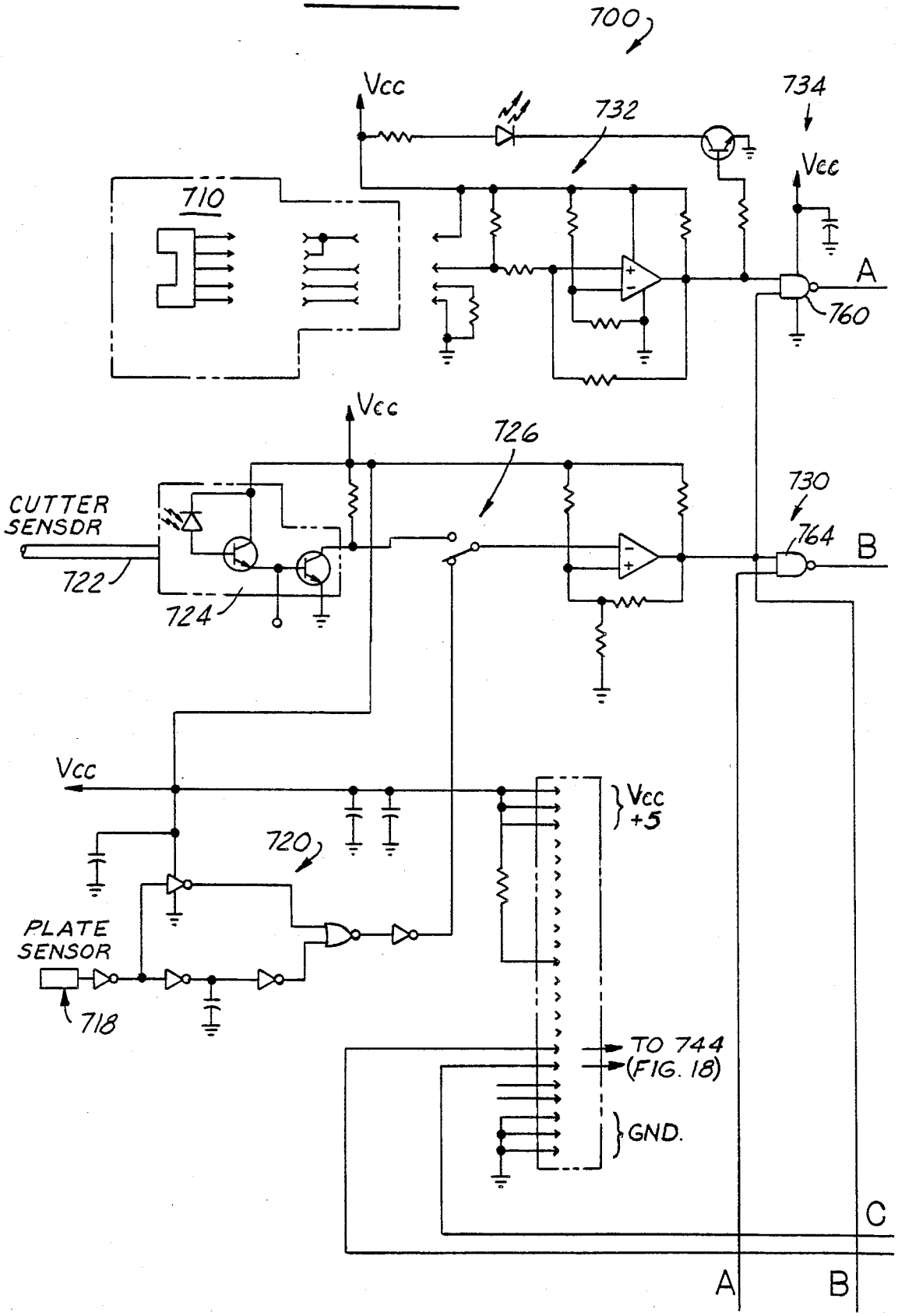
FIGS. 19A, 19B, 19C taken together are a schematic diagram of the electronic circuits.
Figure 19B:
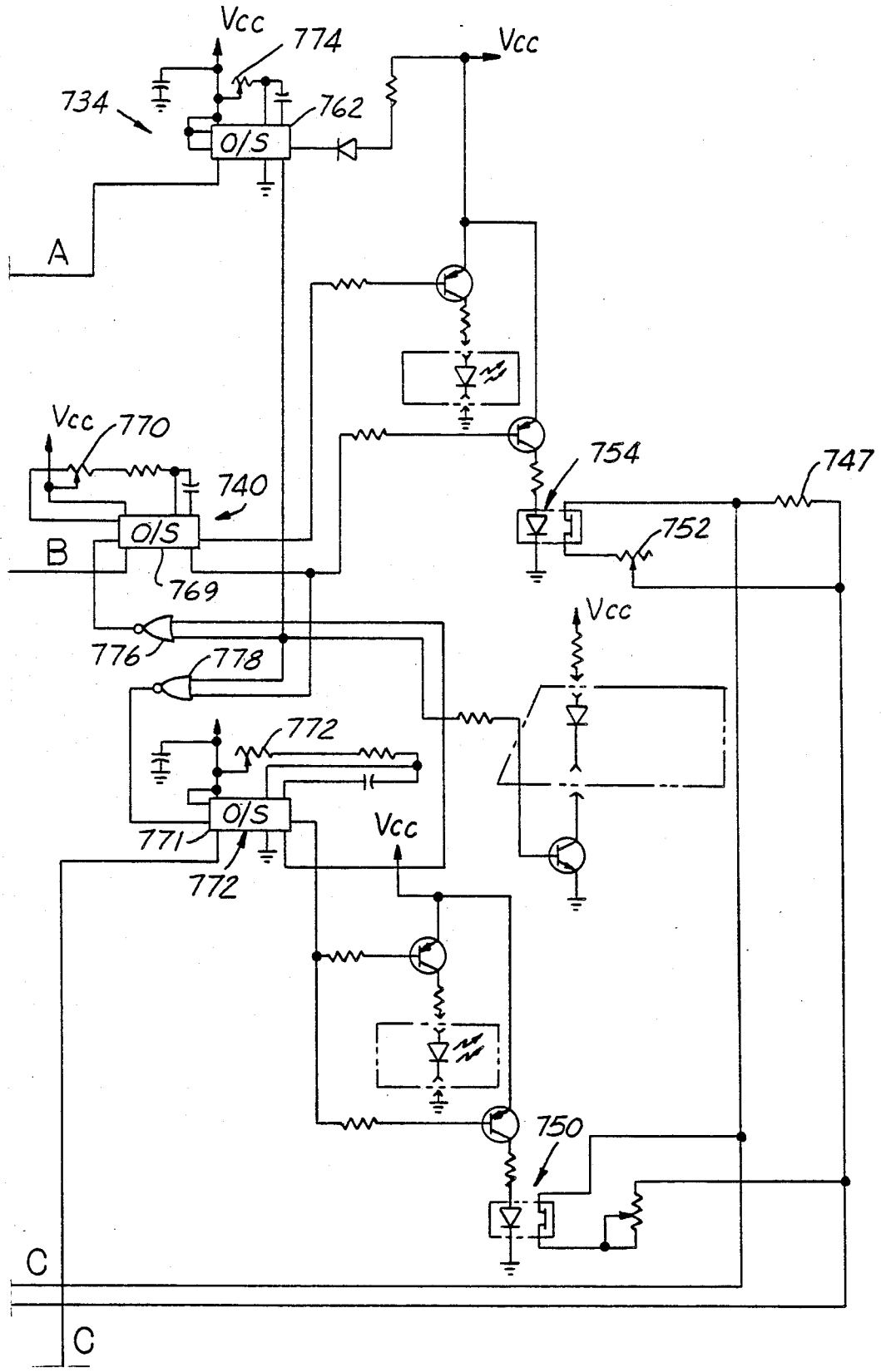
Figure 19C:
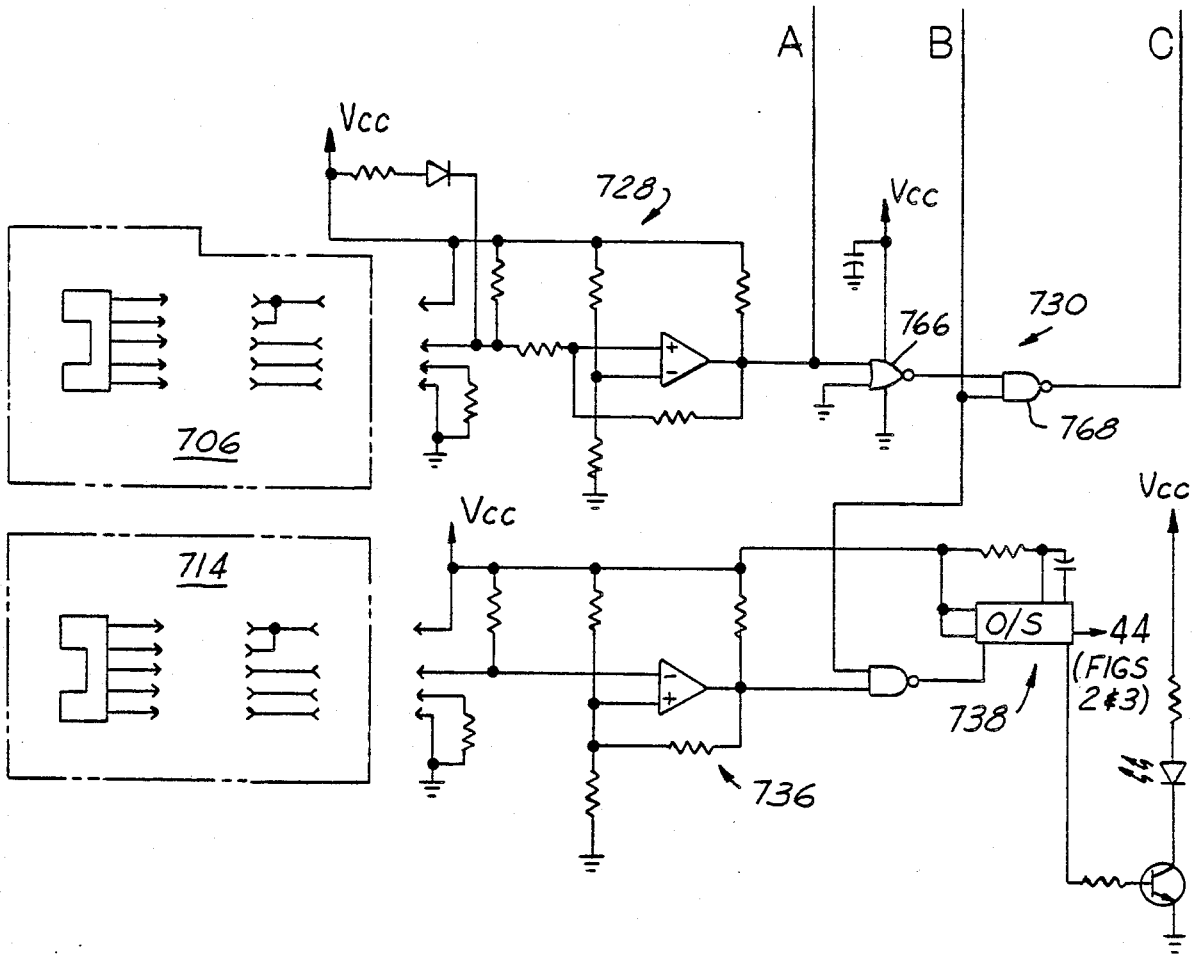

FIGS. 19A–19C together comprise a detailed electrical schematic diagram of synchronization electronics 700 illustrated in block form in FIG. 18. FIGS. 19A, 19B are interconnected along the lines A—B in each figure, FIG. 19A, 19C are interconnected along the lines A—C in each figure, and FIGS. 19B, 19C are interconnected along the lines B—C in each figure. Circuits illustrated functionally in FIG. 18, and hereinabove described in connection therewith, are indicated by identical reference numerals in FIGS. 19A–C. Individual circuit elements and components are schematically illustrated in conventional manner. Such individual elements and components, including integrated circuits, may be of any suitable manufacture. Speed-increase circuit 740 (FIGS. 18 and 19B) comprises a retriggerable one-shot 769 having a duration time determined in part by a variable resistor 770. Likewise, speed-decrease circuit 742 comprises a retriggerable one-shot 771 having a duration time determined in part by a variable resistor 772.

The output of sensor 710 (FIGS. 18 and 19A) is fed through detector 732 to speed correction enabling electronics 734 (FIG. 19A and 19B), which includes a gate 760 having one input connected to detector 732 and a second input from signal selector 726 (FIG. 19A). The output of gate 760 energizes or triggers a one-shot 762 (FIG. 19B) when the pulsed output of selector 726 from plate sensor 718 (or cutter sensor fiber optic 722) occurs while sensor 710 is adjacent to aperture 712. The output of one-shot 762 is connected through a pair of or gates 776,778 to the clearing inputs of one-shots 769,771 so as to disable operation thereof. Thus, as previously indicated, speed adjustment is disabled by circuit 734, specifically by one-shot 762, when the plate sensor signal is received within the time window represented by slot 712 (FIG. 18). Output of each one-shot 769,771 also disables the other through gates 776,778 to prevent simultaneous attempted speed-increase and speed-decrease adjustment.

Circuit 730 (FIGS. 18, 19A and 19C), for selecting between speed-increase and speed-decrease adjustment, includes a first gate 764 (FIG. 19A) which has one input from signal selector 726 and another input from detector 728 (FIGS. 18 and 19C). The output of gate 764 triggers one-shot 740 (FIG. 19B) when the pulsed output from selector 726 occurs while sensor 706 is between teeth 708, indicating that speed-increase adjustment is required. Likewise, increase/decrease speed correction electronics 730 include a second gate 768 (FIG. 19C) having an input coupled through an inverter 766 to detector 728 and another input connected to selector 726. The output of gate 768 triggers one-shot 771 (FIG. 19B) when the pulsed output of selector 726 occurs while sensor 706 is adjacent to a tooth 708, thus indicating need for a speed-decrease adjustment. Electronic switches 750, 754 preferably comprise optical FETs. The various synchronization control one-shots also drive LEDs illustrated in FIGS. 19A–19B for indicating control mode of operation to an operator.

Variable resistors 770,772 permit independent empirical adjustment of speed correction time durations in both the speed-increase and speed-decrease directions. Likewise, resistors 752, 748 are adjustable for empirically setting the magnitude of speed command current change in both increasing and decreasing adjustment modes, again independently of each other. Thus, both speed-increasing and speed-decreasing motor adjustments are accomplished by either decreasing or increasing speed command current motor controller 744 by a preselected amount determined by resistors 752,748, and for a preselected time duration determined by resistors 770,772. Of course, if the motor speed is sufficiently out of synchronization, adjustment one-shot 769,771 may be retriggered by the next plate sensor pulse. Neither the magnitude nor the duration of speed adjustment is directly controlled by the magnitude of the synchronization error. One-shot 762 includes a variable resistor for empircally adjusting disabling time.

Operation of Electronically Synchronized Stacker

In operation of the line 20, a coil 24 of a continuous web 26 of grids is unwound by the coiler 22, fed through the take-up 28 and into the paster 30 usually at a lineal speed of about 150 to 200 feet per minute. The paster applies battery paste to the web and preferably over pastes both faces of the web so that it is embedded in the paste. To facilitate handling the pasted web and plates, preferably a strip of paper is applied to at least the bottom face and preferably both faces of the web.

The pasted web 26′ passes into the rotary cutter 32 which completely cuts or severs individual battery plates 34 from the web. Since the extent along the longitude of the web of an individual grid is usually in the range of 4 to 6 inches, the plates emerge from the rotary cutter at a rate of about 300 to 600 per minute.

Preferably, to facilitate further handling and processing of the plates, they are moved by conveyor 36 through the flash oven 38 which heats and removes moisture from the exterior surface or skin of the paste to thereby strengthen it and hence the plate while still leaving the core of the paste with a higher moisture content and in a relatively soft and pliable condition. Preferably, to reduce the risk of jamming, the conveyor 36 accelerates the plates to increase the gap or distance between adjacent plates. This is accomplished by operating conveyor 36 at a greater lineal speed than that of the plates emerging from the cutter.

As the plates leave the oven conveyor, they pass into the entry conveyor 42 of the stacker 40. For the plates to be piled in stacks, the fingers 200 of the carrier conveyor 48 must be synchronized with the moving plates on the entry conveyor 42. This synchronization is accomplished by the electronic circuitry 700 varying and controlling the speed of the drive motor 256 for the carrier conveyor. If plates are improperly synchronized, the circuitry 700 activates the abort mechanism 44 to direct plates out of the stacker. The abort mechanism is activated by energizing cylinder 138 to extend its piston rod so that the mechanism is shifted from the position shown in FIG. 5 to that shown in FIG. 6. When activated, as the plates approach the exit end of the entry conveyor 42, they are engaged by the belts 128 and pass under the rollers 130 and 132 which causes them to move around the exit end of the entry conveyor belt 80 and pass out of the system through the gap between the belts 80 and 144 of the entry and transfer conveyors 42 and 46.

When the control circuitry 700 indicates the fingers 200 are synchronized, the abort mechanism 44 is deactivated by energizing the cylinder 138 to retract its piston rod and thereby move the mechanism to the raised position shown in FIGS. 3 and 5. When the abort mechanism is deactivated, the plates pass from the entry conveyor under the abort mechanism and onto the transport conveyor 46 in properly timed and spaced relationship to be picked up by the carrier conveyor 48.

As shown in FIG. 12, as each plate 34 approaches the lower end of the transfer conveyor, it is picked up and removed by a pair of underlying fingers 200 of the carrier conveyor.

The plates are piled up in a stack alternately on one and then the other of the elevators 50 and 52. The plates are caused to pile up in a stack by actuating alternately one and then the other of the stop mechanisms 54 and 56 so that, as shown in FIG. 12, its associated bumper pad is disposed in the path of the plates being advanced by the carrier conveyor to engage the leading edge of each plate when it is disposed over the conveyor associated with the stop mechanism. Each stop mechanism is actuated by energizing its cylinder 296 to extend its piston rod to rotate its pad 272 generally downward into the path of the plates.

As each plate strikes the pad 272 of the stop mechanism, it is rapidly decelerated so that its forward motion stops while the underlying fingers 200 being advanced by its conveyor slide out from under the plate and thereby gently lower the plate either directly onto an underlying plate previously deposited on the elevator or at the beginning of each stack directly onto the elevator. As each plate strikes the pad 272 and is decelerated, energy is absorbed and dissipated by the energy absorbing rubber of the pad. Energy is also dissipated by the shock absorber 282 which is actuated by the plate causing a slight rotation through a few degrees of the shaft 276 which is operably connected to the shock absorber through the lever arm 286. To avoid damage to the plates, the deceleration is also slightly cushioned during initial rotation of the shaft by the inertia of the counterweight 292. When a plate 34 initially strikes the stop pad 272, it usually rebounds or has some retrograde movement and is then again urged to bear on the stop by the moving carrier fingers 200 which continue to frictionally engage the plates. This insures accurate alignment of the plates with the stop and hence in the stack.

While plates are being piled in a stack on an elevator 50 or 52, it is retracted by energizing its associated drive cylinder 318 so that the plates already on the elevator will not be struck by succeeding plates moved over the elevator and into engagement with the stop pad 272 by the carrier conveyor 48. Preferably, the lowering or retraction of the elevator is controlled by a conventional photoelectric detector and suitable circuitry (not shown) aligned with the desired position of the uppermost grid in the stack.

When the desired number of plates have been piled in a stack on the elevator 50, (or the stack reaches a predetermined height), its associated stop 54 is de-energized and the stop mechanism 56 associated with the other elevator 52 is energized. Stop mechanism 54 is deactivated by actuating its cylinder to move the mechanism to the raised position shown in phantom in FIG. 12 so that its stop pad 272 is removed from the path of the plates on the carrier conveyor 48. Deactivation of the stop 54 and actuation of the stop 56 may be controlled by conventional electro-pneumatic circuitry and a limit switch tripped by the dog 332 on the elevator 50 (not shown). Similarly, the stop mechanism 56 may be deactivated and the stop 54 activated by conventional electro-pneumatic circuitry and a limit switch (not shown) tripped by the dog 332 on the elevator 52. A suitable time delay is provided in this circuit for the deactivatation of the stop mechanism 56 to insure that all plates which have passed the stop mechanism 54 will be piled in a stack on the elevator 52 before its associated stop mechanism 56 is deactivated.

After each stack of plates is formed, it is deposited on its associated stack removal conveyor 60 or 62 by lowering its associated elevator 50 or 52 below the chains 356 of the stack conveyor. After a stack of plates is deposited on a stack conveyor, the stack is advanced by the chains and thereby removed from over the elevator by energizing its drive cylinder 380 to retract its piston rod 390. Retraction of the piston rod rotates the drive sprockets 360 hence the conveyor chain 356 counterclockwise (as viewed in FIG. 14) to advance the stack on the conveyor. The cylinder is then activated to return its piston rod to its extended position which due to the one way clutch 382 does not rotate the conveyor chains. Actuation of the drive cylinder can be controlled by conventional electro-hydraulic circuitry and a limit switch (not shown) tripped by the dog 334 of its associated conveyor. Stacks of plates on the stacker conveyors 60 and 62 can be removed for further processing either manually or by a transfer mechanism (not shown).

Mechanically Synchronized Stacker

Figures 20, 22:
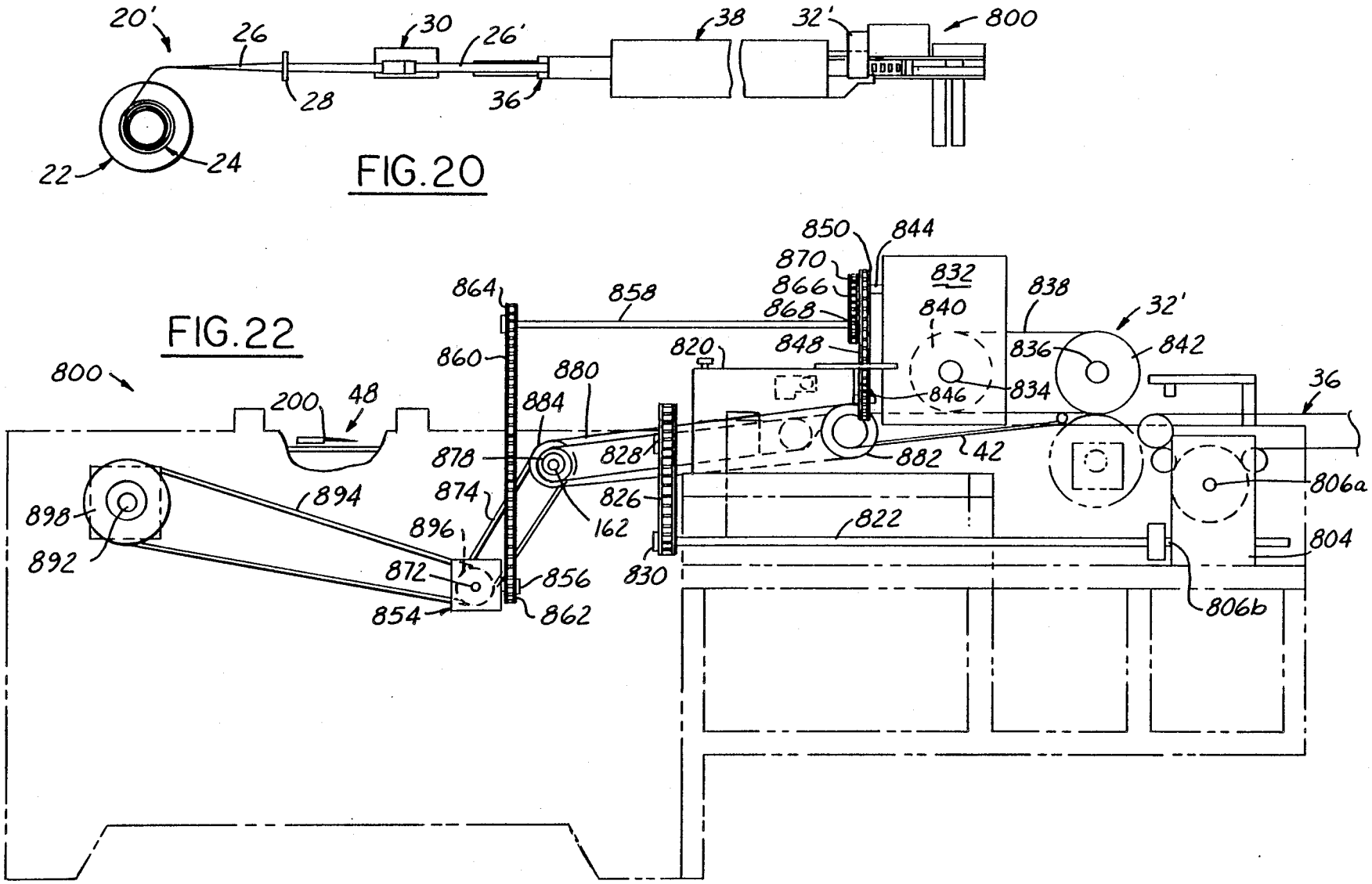
FIG. 20 is a semi-schematic top view of a production line for battery plates with an alternate embodiment of a plate stacker embodying this invention.
FIG. 22 is an enlarged side view with portions broken away of the stacker taken in the direction of arrow 22 in FIG. 21.
Figure 21:
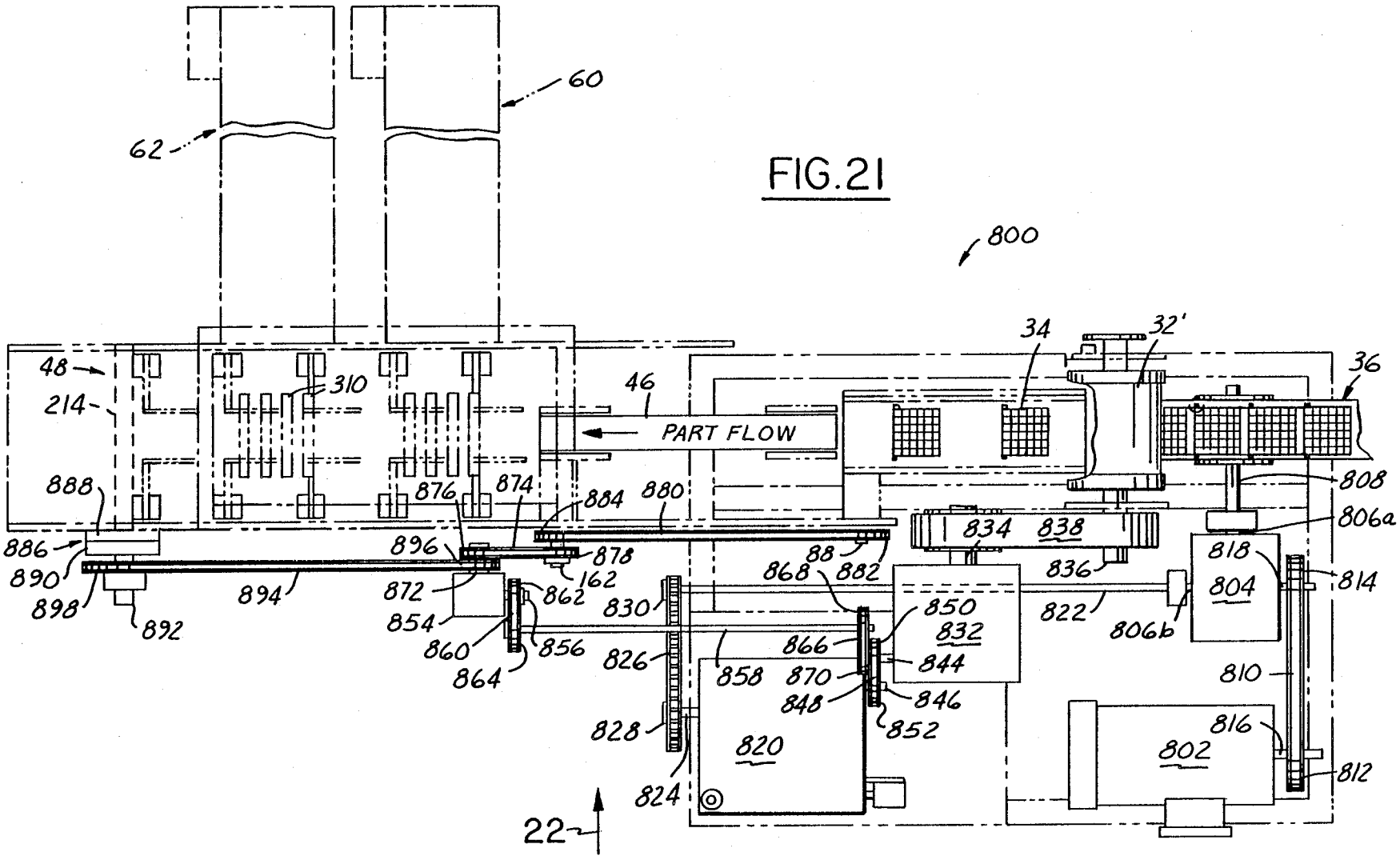
FIG. 21 is an enlarged top view of the stacker of FIG. 20.

FIGS. 20 through 22 illustrate a modified stacker 800 of this invention utilizing mechanical synchronization. FIG. 20 illustrates a production line 20′ for battery plates in which a continuous web 26 passes through a take-up stand 28, pasting machine 30 and preferably a flash drying oven 38.

After the web 26 emerges from the oven, it is advanced by the conveyor 36 into a rotary plate cutter 32′ which completely severs or cuts individual pasted battery grids or plates 34 from web 26 which are then stacked. Alternatively, if desired, a web which has been prepasted and precured can be feed directly into the cutter to produce plates 34 which are then stacked. The major components of the preferred stacker 40 are also in stacker 800, with the exception of the stacker motor speed control electronics 700 and drive motors.

Stacker 800 utilizes a single main drive motor 802 to drive the main conveyor 36, rotary cutter 32′, entry conveyor 42, transfer conveyor 46 and carrier conveyor 48. As shown in FIGS. 21 and 22, the main conveyor 36 is driven by the drive motor 802 through a speed reducer gear box 804 having a pair of output shafts 806*a*, 806*b*. Output shaft 806*a* is connected to the drive shaft 808 of the main conveyor 36. The motor 802 is connected to the gear box 804 by a belt 810 received on pulleys 812 and 814 keyed respectively to the motor output shaft 816 and speed reducer gear box input shaft 818.

The other conveyors 42, 46 and 48 and the cutter 32′ are all driven through a phase shift and draw transmission 820 which enables both their speed and phase to be varied and adjusted relative to the conveyor 36. The output speed of transmission 820 can be increased or decreased up to about 2% by manually adjusting the control knob 821 to fine tune synchronization of the lineal speed of the cutter 32′ with that of the web 20 fed by the main conveyor 36′. By changing the phase the cutter can be synchronized with the plates of the web being fed by the conveyor 36 to cut the web at the desired location. This transmission 820 is driven through the gear box output shaft 806*b* which is connected to an extension shaft 822. The input shaft 824 of the transmission is connected to the extension shaft 822 by a timing belt 826 received on cog pulleys 828 and 830 keyed to the shafts.

The length of the plates cut from the web can be varied and changed to produce plates of any desired length. To produce plates of different desired lengths usually the number of blades, diameter of the cutter and/or the rotary speed at which the cutter blades are driven relative to the speed of conveyor 36 is changed. The rotary cutter 32' is driven through a speed reducer 832 with an output shaft 834 connected to a cutter drive shaft 836 by a timing belt 838 received on cog pulleys 840 and 842 keyed to the shafts. The input shaft 844 of the speed reducer is connected to the output shaft 846 of the transmission 820 by a timing belt 848 received on cog pulleys 850 and 852 keyed to the shafts.

The conveyors 42, 46 and 48 are driven at the same lineal surface speed through a speed change gear box 854 with an input shaft 856 connected to an extension shaft 858 by a timing belt 860 received on cog pulleys 862 and 864 keyed to the shafts. The extension shaft is connected to the input shaft 844 of the speed reducer 832 by a timing belt 866 and cog pulleys 868 and 870 keyed to the shafts. Gross changes in the lineal surface speed of these conveyors 42, 46 and 48 relative to the lineal surface speed of the conveyor 36 can be varied and adjusted by changing the ratio of the diameters of the cog pulleys 862 and 864.

The drive shaft 162 of the conveyor 46 is connected to the gear box output shaft 872 by a timing belt 874 received on cog pulleys 876 and 878 keyed to the shafts. The drive shaft 88 of the conveyor 42 is connected to the drive shaft 162 by a timing belt 880 received on cog pulleys 882 and 884 keyed to the shafts.

The carrier conveyor 48 is driven through a phase changer 886 for synchronizing its conveyor fingers 200 with the plates 34 on the transfer conveyor 46. The phase changer has a pair of disks 888 and 890 which can be releasably secured together in any desired angular or phase relationship. The disk 888 is keyed to the drive shaft 214 of the conveyor 48. The disk 890 is keyed to a stub shaft 892 which is connected to the gear box output shaft 872 by a timing belt 894 received on cog pulleys 898 and 896 keyed to the shafts.

To insure the cutter is continuously synchronized to cut the web at the correct locations, an electronic control apparatus 920 is used to vary and adjust the phase of transmission 820 and hence the cutter 32'. The phase is adjusted by turning a shaft 922 of the transmission by a stepper motor 924 operated by the electronic control. The electronic control includes a control circuit (not shown), a pair of sensors 926, 928, and a timing disc 930. The sensor 926 is responsive to each lug 932 (of a plate) along one edge of the web to indicate to the control circuit the location on the web to be cut. The sensor 926 is positioned adjacent to the path of the travel of the web on a bracket 932 located over the main conveyor. The sensor 926 is spaced from the axis of the cutter 32', a distance equal to the desired length of an individual plate 34 or a multiple thereof. This spacing can be adjusted to produce plates of any desired length.

The timing disc 930 is mounted on the cutter drive shaft 836 and has one or more radially extending slots 934 formed in the periphery thereof. Each slot 934 corresponds to and is radially and circumferentially aligned with a specific cutter blade on the cutter. If the cutter has a plurality of blades they are equally circumferentially spaced about the cutter. The second sensor 928 is disposed adjacent to the drive shaft 836 and positioned so as to sense passage of the indicating slots 934 in disc 930 and provide an input to the control circuit when a blade is cutting the web i.e. aligned with a line passing through the centers of both the cutter shaft 836 and the shaft 936 of the anvil cylinder 938.

In operation, the first and second sensors 926, 928 send signals to a control circuit which compares them to determine if the phase of the cutter to the web is correct. If the phase is incorrect the control circuit provides an output control signal to the stepper motor 924 to advance or retard the phase of the cutter so that it will sever the web in the correct location. This control apparatus is fully disclosed in U.S. Pat. No. 4,543,863 the disclosure of which is incorporated herein by reference and hence its construction and operation will not be further described herein.

Figure 23:
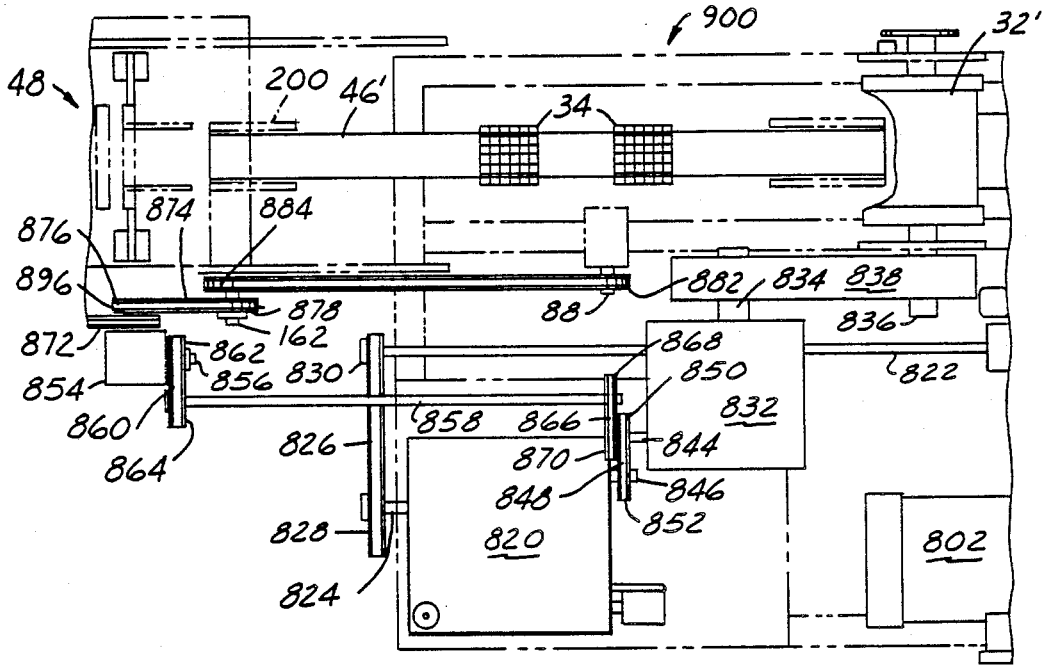
FIG. 23 is an enlarged fragmentary top view of a modified stacker having no abort mechanism.
Figure 24:
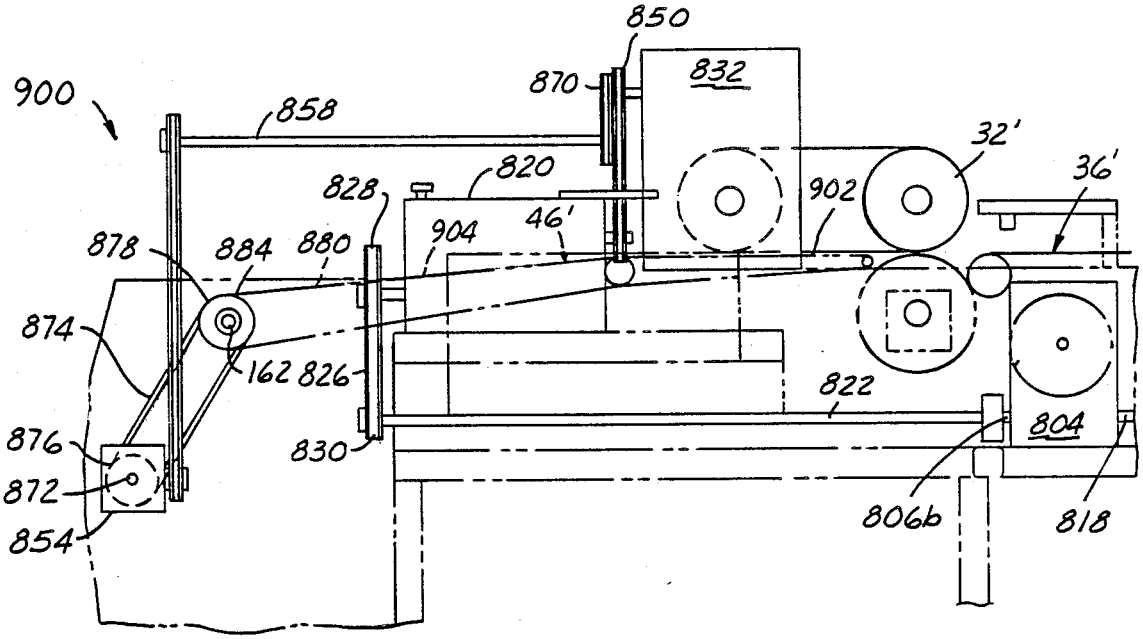
FIG. 24 is an enlarged fragmentary side view with portions broken away of the stacker of FIG. 23.

FIGS. 23–24 illustrate a modified stacker 900 without an abort mechanism 44 and an entry conveyor 42. As shown in FIG. 23, a longer transfer conveyor 46' delivers individual pasted grids 34 directly from the rotary cutter 32' to the cantilevered fingers 200 of the carrier conveyor 48. With the elimination of the abort mechanism, the space between the entry conveyor 42 and transfer conveyor 46 is no longer needed.

As shown in FIG. 24, the entry portion 902 of the upper run of the transfer conveyor 46' is preferably substantially horizontal and preferably the exit portion 904 is inclined or sloped downwardly at an acute included angle which is desirably in the range of about 2°–15°, and preferably about 3°–10°. This exit portion 904 is adjacent the carrier conveyor 48 and delivers the pasted grids 34 to the cantilevered fingers 200.

The mechanical synchronization of this modified stacker 900 is the same as that of the stacker 800 having an abort mechanism. Preferably the transfer conveyor 46' uses both drive shafts 88 and 162 which previously drove the entry conveyor 42 and the transfer conveyor 46. Therefore, the same mechanical drive and synchronization mechanisms are used in both stackers 800 and 900. However, if desired, the drive for shaft 88 can also be eliminated from stacker 900.

In stacker 900, if there is a need to abort plates, both stop mechanisms 54 and 56 will be rotated to their inoperative position to allow the individual plates to pass by the elevators and drop off the downstream end of the carrier conveyor.

Operation of Mechanically Synchronized Stacker

The mechanically synchronized stackers 800 and 900 operate in essentially the same manner as the electrically synchronized stacker 40 except that synchronization of the conveyors is achieved mechanically rather than electronically. In all of the stackers, plates 34 are not stacked until both the cutter 32 or 32' severs the web 26 in the correct location and the fingers 200 of the carrier conveyor are correctly synchronized to pick up plates from the transfer conveyor 46 or 46'.

In the stackers 800 and 900, synchronization between the cutter 32 and the web 26 is accomplished by the phase and draw transmission 820. Transmission 820 adjusts the speed and phase of the cutter 32' to line up its cutter blades on the desired line of division or separation between adjacent plates 34 in the web. After synchronization of cutter 32' and the web is achieved, the phase relationship of the carrier conveyor fingers 200 with the transfer conveyor 46 or 46' is synchronized. The phase of the fingers 200 is synchronized by manual adjustment of the phase changer 886. The angular relationship of the disk 890 to the disk 888 on the phase changer is adjusted until the cantilevered fingers 200 assume the proper position to pick up plates 34 from the transfer conveyor 46 or 46'.

In stacker 800, the abort mechanism 44 is activated to deflect plates out of the system until synchronization is achieved and then it is deactivated to permit the plates to be stacked. In stacker 900, the stop mechanisms 54 and 56 are actuated so that the plates pass through the stacker and drop off the downstream end of the carrier conveyor 48 until synchronization is achieved. Thereafter, the stops are alternately actuated to their operative positions to stack the plates on the elevators. In both stackers 800 and 900, the stop mechanisms 54 and 56, elevators 50 and 52 and stacker conveyors 60 and 62 operate to stack and remove piles of plates in the same manner as in the electronically synchronized stacker 40.

We claim:

1. A battery plate stacker for stacking a plurality of individual battery plates in piles comprising: a first conveyor constructed and arranged to advance along a first path a series of consecutive individual battery plates, at least first and second plate receiving stations spaced from and downstream of said first conveyor, said second station being spaced from and downstream of said first station, a second conveyor constructed and arranged to receive synchronized plates from said first conveyor and to carry and advance synchronized plates into said stations, drive means for at least one of said first and second conveyors, synchronizing means operatively associated with said drive means for controlling and varying the relative lineal speed of said first and second conveyors to synchronize plates received on said first conveyor with said second conveyor for being carried and advanced thereby to said stations, an abort mechanism disposed between said first and second conveyors and constructed and arranged to deflect out of the series of plates being conveyed by said first conveyor and away from said second conveyor individual plates which are not synchronized with said second conveyor, an elevator associated with each station for receiving plates and constructed and arranged to be lowered as each plate is deposited in said station so that the next succeeding plate to be deposited can be received thereon, a first stop mechanism associated with said first station and having operable and inoperable positions, a second stop mechanism associated with said second station and having at least an operable position, each of said stop mechanisms in its operable position being constructed and arranged to engage and rapidly stop each of a plurality of succeeding plates carried into its associated station by said second conveyor to deposit them in a stack on the elevator associated with such station, and control means associated with at least said first stop mechanism and constructed and arranged to actuate said first stop mechanism to its operable position to deposit a plurality of plates in a stack on the elevator associated with said first station, and to its inoperable position to cease depositing plates in said first station and to permit plates to be carried through said first station by said second conveyor and into said second station to be engaged and rapidly stopped by said second stop mechanism in its operable position to deposit plates in a stack on the elevator associated with said second station, whereby a stack of a plurality of plates is deposited sequentially on one and then another of said elevators.

2. The battery plate stacker of claim 1 which also comprises a transfer conveyor disposed between said first conveyor and said second conveyor and constructed and arranged to receive synchronized plates from said first conveyor and advance them to said second conveyor, said transfer conveyor having an upper run inclined downwardly to the path of travel of plates on said second conveyor at an acute included angle in the range of about 2° to 15° so that the leading edges of the plates received on the upper run are generally vertically below their respective trailing edges, an adjacent end portion of the upper run of said transfer conveyor and said second conveyor being overlapped, and in said overlapped portion, said second conveyor picks up synchronized plates from said transfer conveyor.

3. The battery plate stacker of claim 2 wherein said second conveyor also comprises a plurality of spaced apart pairs of fingers on which synchronized plates are received, the fingers of each pair being laterally spaced apart sufficiently to pass by generally opposite sides of said upper run of said transfer conveyor in said overlapped portion to pick up a plate from said transfer conveyor.

4. The battery plate stacker of claim 3 wherein said fingers of each pair when carrying a plate into a plate receiving station are inclined at an acute included angle to their path of travel in the range of 2° to 10° so that the leading edge of the plate received on the fingers is disposed generally vertically above the trailing edge of such plate and such trailing edge of such plate is disposed generally vertically below the leading edge of the immediately succeeding plate.

5. The battery plate stacker of claim 1 wherein adjacent end portions of upper runs of said first and second conveyors are overlapped, and said second conveyor also comprises a plurality of spaced apart pairs of fingers on which synchronized plates are received, the fingers of each pair being laterally spaced apart sufficiently to pass by generally opposite sides of the upper run of said first conveyor in said overlapped portion to pick up a plate from said first conveyor.

6. The battery plate stacker of claim 5 wherein said fingers of each pair when carrying a plate into a plate receiving station are inclined at an acute included angle to their path of travel in the range of 2° to 10° so that the leading edge of the plate received thereon is disposed generally vertically above the trailing edge of such plate and such trailing edge of such plate is disposed generally vertically below the leading edge of the immediately succeeding plate.

7. The battery plate stacker of claim 1 wherein said abort mechanism comprises a frame, a pair of spaced apart idler rollers journalled for rotation and carried by said frame, at least one flexible endless belt received on said rollers, and an actuator constructed and arranged to move said rollers to an inoperative position wherein there is sufficient clearance between them and the upper run of said first conveyor that plates pass between them without contacting said rollers and flexible belt received thereon, and to a second operable position wherein as each plate approaches the exit of said first conveyor, said belt bears thereon and deflects the plate so that it disengages from said first conveyor and is not received by said second conveyor.

8. The battery plate stacker of claim 7 wherein the downstream one of said rollers is journalled for rotation on said frame, and the upstream one of said rollers is pivotally carried by said frame for pivotal movement relative to said frame.

9. The battery plate stacker of claim 1 wherein at least said first stop mechanism comprises a stop pad movable to inoperable and operable positions and when in its operable position is disposed in the path of plates being advanced by said second conveyor so as to be struck by and bear on the leading edge of the plates, and a shock absorber operably connected with said stop pad to absorb and dissipate at least some of the energy transmitted to said stop pad by a plate striking it.

10. The battery plate stacker of claim 9 wherein said stop pad comprises a somewhat flexible and energy absorbing and dissipating material having a durometer reading in the range of 40 to 70 on the Shore A Scale.

11. The battery plate stacker of claim 9 wherein said stop mechanism also comprises a counterweight operably connected to said stop pad and constructed and arranged to yieldably resist movement of said stop pad by a battery plate striking it.

12. The battery plate stacker of claim 11 wherein said stop pad comprises a somewhat flexible and energy absorbing and dissipating material having a durometer reading in the range of 40 to 70 on the Shore A Scale.

13. The battery plate stacker of claim 1 wherein at least said first stop mechanism comprises, a stop pad movable to inoperable and operable positions and when in its operable position is disposed in the path of plates being advanced by said second conveyor to be struck by and bear on the leading edge of the plates, a shock absorber operably connected with said stop pad to absorb and dissipate at least some of the energy transmitted to said stop pad by a plate striking it, and means yieldably mounting said stop pad so that said stop pad moves within predetermined limits when struck by a battery plate to thereby avoid damaging such battery plate while still permitting it to be rapidly decelerated by said stop mechanism.

14. The battery plate stacker of claim 1 which also comprises a third conveyor operably associated with at least one of said elevators for receiving and removing from said elevator a completed stack of plates carried by said elevator.

15. The battery plate stacker of claim 14 wherein said third conveyor has an upper run which underlies its associated station and crosses the path of travel of its associated elevator so that after a stack of plates is completed on such elevator, it can be actuated to deposit the stack on the upper run of said third conveyor and thereafter said third conveyor can be cycled to remove such stack of plates from the path of travel of such elevator.

16. The battery plate stacker of claim 15 which also comprises an actuator operably connected to said third conveyor to intermittently cycle said third conveyor to remove each completed stack of plates from the path of its associated elevator and advance completed stacks of plates along the upper run of said third conveyor.

17. The battery plate stacker of claim 2 wherein at least said first stop mechanism comprises a stop pad movable to inoperable and operable positions and when in its operable position is disposed in the path of plates being advanced by said second conveyor so as to be struck by and bear on the leading edge of the plates, and a shock absorber operably connected with said stop pad to absorb and dissipate at least some of the energy transmitted to said stop pad by a plate striking it.

18. The battery plate stacker of claim 4 wherein at least said first stop mechanism comprises a stop pad movable to inoperable and operable positions and when in its operable position is disposed in the path of plates being advanced by said second conveyor so as to be struck by and bear on the leading edge of the plates, and a shock absorber operably connected with said stop pad to absorb and dissipate at least some of the energy transmitted to said stop pad by a plate striking it.

19. A battery plate stacker for stacking a plurality of individual battery plates in piles comprising: a first conveyor constructed and arranged to advance along a first path a series of consecutive individual battery plates, at least first and second plate receiving stations spaced from and downstream of said first conveyor, said second station being spaced from and downstream of said first station, a second conveyor constructed and arranged to receive synchronized plates from said first conveyor and to carry and advance synchronized plates into said stations, adjacent end portions of the upper runs of said first and second conveyors being overlapped, said second conveyor having a plurality of longitudinally spaced apart pairs of fingers on which synchronized plates are received, the fingers of each pair being laterally spaced apart sufficiently to pass by generally opposite sides of said upper run of said first conveyor in said overlapped portion to pick up a plate from said first conveyor, an elevator associated with each station for receiving plates and constructed and arranged to be lowered as each plate is deposited in said station so that the next succeeding plate to be deposited can be received thereon, a first stop mechanism associated with said first station and having operable and inoperable positions, a second stop mechanism associated with said second station and having at least an operable position, each of said stop mechanisms in its operable position being constructed and arranged to engage and rapidly stop each of a plurality of succeeding plates carried into its associated station by said second conveyor to deposit them in a stack on the elevator associated with such station, when a plate is received on a pair of said fingers they underlie and support said plate in a generally horizontal plane and retain the plate thereon only by frictional engagement therewith and when such plate is engaged by one of said stops said pair of fingers pass out from under and beyond such plate to thereby deposit such plate in a stack in the station associated with such stop mechanism, and control means associated with at least said first stop mechanism and constructed and arranged to actuate said first stop mechanism to its operable position to deposit a plurality of plates in a stack on the elevator associated with said first station, and to its inoperable position to cease depositing plates in said first station and to permit plates to be carried through said first station by said second conveyor and into said second station to be engaged and rapidly stopped by said second stop mechanism in its operable position to deposit plates in a stack on the elevator associated with said second station, whereby a stack of a plurality of grids is deposited sequentially on one and then another of said elevators.

20. A battery plate stacker for stacking a plurality of individual battery plates in piles comprising: a first conveyor constructed and arranged to advance along a first path a series of consecutive individual battery plates, at least first and second plate receiving stations spaced from and downstream of said first conveyor, said second station being spaced from and downstream of said first station, a second conveyor constructed and arranged to receive synchronized plates from said first conveyor and to carry and advance synchronized plates into said stations, adjacent end portions of the upper runs of said first and second conveyors being overlapped, said second conveyor having a plurality of longitudinally spaced apart pairs of fingers on which synchronized plates are received, the fingers of each pair being laterally spaced apart sufficiently to pass by generally opposite sides of said upper run of said first conveyor in said overlapped portion to pick up a plate from said first conveyor, said fingers of each pair when carrying a plate into a work station underlie such plate and are inclined at an acute included angle to their path to travel in the range of 2° to 10° so that the leading edge of the plate received thereon is disposed generally vertically above the trailing edge of such plate and such trailing edge of such plate is disposed generally vertically below the leading edge of the immediately succeeding plate, an elevator associated with each station for receiving plates and constructed and arranged to be lowered as each plate is deposited in said station so that the next succeeding plate to be deposited can be received thereon, a first stop mechanism associated with said first station and having operable and inoperable positions, a second stop mechanism associated with said second station and having at least an operable position, each of said stop mechanism in its operable position being constructed and arranged to engage and rapidly stop each of a plurality of succeeding plates carried into its associated station by said second conveyor to deposit them in a stack on the elevator associated with such station, and control means associated with at least said first stop mechanism and constructed and arranged to actuate said first stop mechanism to its operable position to deposit a plurality of plates in a stack on the elevator associated with said first station, and to its inoperable position to cease depositing plates in said first station and to permit plates to be carried through said first station by said second conveyor and into said second station to be engaged and rapidly stopped by said second stop mechanism when in its operable position to deposit plates in a stack on the elevator associated with said second station, whereby a stack of a plurality of grids is deposited sequentially on one and then another of said elevators.

21. The battery plate stacker of claim 20 wherein said upper run of said first conveyor is inclined downwardly to said upper run of said second conveyor at an acute included angle in the range of about 2° to 15° so that the leading edges of the plates received on such upper run of said first conveyor are generally vertically below their respective trailing edges when the plates are initially presented to said second conveyor.

22. The battery plate stacker of claim 19 wherein said fingers of each pair when carrying a plate into a plate receiving station are inclined at an acute included angle to their path of travel in the range of 2° to 10° so that the leading edge of the plate received thereon is disposed generally vertically above the trailing edge of such plate and such trailing edge of such plate is disposed generally vertically below the leading edge of the immediately succeeding plate.

23. The battery plate stacker of claim 20 wherein at least said first stop mechanism comprises a stop pad movable to inoperable and operable positions and when in its operable position disposed in the path of plates being advanced by said second conveyor so as to be struck by and bear on the leading edge of the plates, and a shock absorber operably connected with said stop pad to absorb and dissipate at least some of the energy transmitted to said stop pad by a plate striking it.

24. The battery plate stacker of claim 23 wherein said stop pad comprises a somewhat flexible and energy absorbing and dissipating material having a durometer reading in the range of 40 to 70 on the Shore A Scale.

25. The battery plate stacker of claim 23 wherein said first stop mechanism also comprises a counterweight operably connected to said stop pad and constructed and arranged to yieldably resist movement of said stop pad by a battery plate striking it.

26. The battery plate stacker of claim 25 wherein said stop pad comprises a somewhat flexible and energy absorbing and dissipating material having a durometer reading in the range of 40 to 70 on the Shore A Scale.

27. A battery plate stacker for stacking a plurality of individual battery plates in piles comprising: a first conveyor constructed and arranged to advance along a first path a series of consecutive individual battery plates, at least first and second plate receiving stations spaced from and downstream of said first conveyor, said second station being spaced from and downstream of said first station, a second conveyor constructed and arranged to receive synchronized plates from said first conveyor and to carry and advance synchronized plates into said stations, an abort mechanism disposed between said first and second conveyors and constructed and arranged to deflect out of the series of plates being conveyed by said first conveyor and away from said second conveyor individual plates which are not synchronized with said second conveyor, an elevator associated with each station for receiving plates and constructed and arranged to be lowered as each plate is deposited in said station so that the next succeeding plate to be deposited can be received thereon, a first stop mechanism associated with said first station and having operable and inoperable positions, a second stop mechanism associated with said second station and having at least an operable position, each of said stop mechanism in its operable position being constructed and arranged to engage and rapidly stop each of a plurality of succeeding plates carried into its associated station by said second conveyor to deposit them in a stack on the elevator associated with such station, and control means associated with at least said first stop mechanism and constructed and arranged to actuate said first stop mechanism to its operable position to deposit a plurality of plates in a stack on the elevator associated with said first station, and to its inoperable position to cease depositing plates in said first station and to permit plates to be carried through said first station by said second conveyor and into said second station to be engaged and rapidly stopped by said second stop mechanism when in its operable position to deposit plates in a stack on the elevator associated with said second station, whereby a stack of a plurality of plates is deposited sequentially on one and then another of said elevators.

28. The battery plate stacker of claim 27 which also comprises a transfer conveyor disposed between said first conveyor and said second conveyor and constructed and arranged to receive synchronized plates from said first conveyor and advance them to said second conveyor, said transfer conveyor having an upper run inclined downwardly to the path of travel of plates on said second conveyor at an acute included angle in the range of about 2° to 15° so that the leading edges of the plates received on the upper run are generally vertically below their respective trailing edges, an adjacent end portion of the upper run of said transfer conveyor and said second conveyor being overlapped, and in said overlapped portion, said second conveyor picks up synchronized plates from said transfer conveyor.

29. The battery plate stacker of claim 28 wherein said second conveyor comprises a plurality of spaced apart pairs of fingers on which synchronized plates are received, the fingers of each pair being laterally spaced apart sufficiently to pass be generally opposite sides of an upper run of said first conveyor in said overlapped portion to underlie and pick up a plate from said first conveyor.

30. The battery plate stacker of claim 29 wherein said fingers of each pair when carrying a plate into a plate receiving station underlie and are inclined at an acute included angle to their path of travel in the range of 2° to 10° so that the leading edge of the plate received thereon is disposed generally vertically above the trailing edge of such plate and such trailing edge of such plate is disposed generally vertically below the leading edge of the immediately succeeding plate.

31. The battery plate stacker of claim 27 wherein adjacent end portions of upper runs of said first and second conveyors are overlapped, and said second conveyor comprises a plurality of spaced apart pairs of fingers on which synchronized plates are received, the fingers of each pair being laterally spaced apart sufficiently to pass by generally opposite sides of the upper run of said first conveyor in said overlapped portion to underlie and pick up a plate from said first conveyor.

32. The battery plate stacker of claim 31 wherein said fingers of each pair when carrying a plate into a plate receiving station underlie and are inclined at an acute included angle to their path of travel in the range of 2° to 10° so that the leading edge of the plate received thereon is disposed generally vertically above the trailing edge of such plate and such trailing edge of such plate is disposed generally vertically below the leading edge of the immediately succeeding plate.

33. The battery plate stacker of claim 27 wherein said abort mechanism comprises a frame, a pair of spaced apart idler rollers journalled for rotation and carried by said frame, at least one flexible endless belt received on said rollers, and an actuator constructed and arranged to move said rollers to an inoperative position wherein there is sufficient clearance between them and the upper run of said first conveyor that plates pass between them without contacting said rollers and flexible belt received thereon, and to a second operable position wherein as each plate approaches the exit of said first conveyor, said belt bears thereon and deflects the plate so that it disengages from said first conveyor and is not received by said second conveyor.

34. The battery plate stacker of claim 33 wherein the downstream one of said rollers is journalled for rotation on said frame, and the upstream one of said rollers is pivotally carried by said frame for pivotal movement relative to said frame.

35. A battery plate stacker for stacking a plurality of individual battery plates in piles comprising a conveyor constructed and arranged to receive synchronized plates and advance them along a path, at least first and second plate receiving stations spaced along said path with said conveyor passing through said stations, each of said stations being spaced apart and said second station being spaced from and downstream of said first station, said conveyor having a plurality of longitudinally spaced apart pairs of fingers which underlie and receive plates thereon, an elevator associated with each station for receiving plates and constructed and arranged to be lowered as each plate is deposited in such station so that the next succeeding plate to be deposited therein can be received thereon, a first stop mechanism associated with said first station and having operable and inoperable positions, a second stop mechanism associated with said second station and having at least an operable position, each of said stop mechanism in its operable position being constructed and arranged to engage and rapidly stop each of a plurality of succeeding plates carried into its associated station by said conveyor to deposit them in a stack on the elevator associated with such station, at least said first stop mechanism having a stop pad movable to inoperable and operable positions and when in its operable position, is disposed in the path of plates being advanced by said conveyor so as to be struck by and bear on the leading edge of the plates, a shock absorber operably connected with said stop pad to absorb and dissipate at least some of the energy transmitted to said stop pad by a plate striking it, and control means associated with at least said first stop mechanism and constructed and arranged to actuate said first stop mechanism to its operable position to deposit a plurality of plates in a stack on the elevator associated with said first station, and to its inoperable position to cease depositing plates in said first station and to permit plates to be carried through said first station by said conveyor and into said second station to be engaged and rapidly stopped by said second stop mechanism when in its operable position to deposit plates in a stack on the elevator associated with said second station, whereby a stack of a plurality of plates is deposited sequentially on one and then another of said elevators.

36. The battery plate stacker of claim 35 wherein said stop pad comprises a somewhat flexible and energy absorbing and dissipating material having a durometer reading in the range of 40 to 70 on the Shore A Scale.

37. The battery plate stacker of claim 35 wherein said stop mechanism also comprises a counterweight operably connected to said stop pad and constructed and arranged to yieldably resist movement of said stop pad by a battery plate striking it.

38. The battery plate stacker of claim 37 wherein said stop pad comprises a somewhat flexible and energy absorbing and dissipating material having a durometer reading in the range of 40 to 70 on the Shore A Scale.

39. The battery plate stacker of claim 35 wherein said first stop mechanism also comprises means yieldably mounting said stop pad so that said stop pad moves within predetermined limits when struck by a battery plate to thereby avoid damaging such battery plate while still permitting it to be rapidly decelerated by said first stop mechanism.

40. The battery plate stacker of claim 35 wherein said second stop mechanism comprises a stop pad which in its operable position is disposed in the path of plates being advanced by said second conveyor so as to be struck by and bear on the leading edge of the plates, and a shock absorber operably connected with said last mentioned stop pad to absorb and dissipate at least some of the energy transmitted to said stop pad by a plate striking it.

41. The battery plate stacker of claim 40 wherein said stop pad of said second stop mechanism is constructed and arranged to be movable to inoperable and operable positions, and when in its operable position is disposed in the path of plates being advanced by said second conveyor to be struck by and bear on the leading edge of the plates, and in its inoperable position permits the plates to be advanced by said conveyor through said second station and past said second stop mechanism.

42. The battery plate stacker of claim 1 which also comprises a third conveyor constructed and arranged to advance along a path a continuous web of a plurality of battery plates, a cutter constructed and arranged to receive said web from said third conveyor and having at least one blade to sever individual battery plates from said web, said first conveyor receiving said individual battery plates, cutter drive means for rotating said cutter, synchronizing means operatively associated with said cutter drive means for controlling and adjusting the rotary speed and phase of said cutter relative to the lineal speed of said third conveyor to synchronize the blades of said cutter with the web, means for controlling and adjusting the lineal speed of said first and second conveyors relative to the lineal speed of said third conveyor, and another synchronizing means for varying and adjusting the phase of said second conveyor relative to said first conveyor.

43. The battery plate stacker of claim 19 which also comprises a third conveyor constructed and arranged to advance along a path a continuous web of a plurality of battery plates, a cutter constructed and arranged to receive said web from said third conveyor and having at least one blade to sever individual battery plates from said web, said first conveyor receiving said individual battery plates, cutter drive means for rotting said cutter, synchronizing means operatively associated with said cutter drive means for controlling and adjusting the rotary speed and phase of said cutter relative to the lineal speed of said third conveyor to synchronize the blades of said cutter with the web, means for controlling and adjusting the lineal speed of said first and second conveyors relative to the lineal speed of said third conveyor, and another synchronizing means for varying and adjusting the phase of said second conveyor relative to said first conveyor.

44. The battery plate stacker of claim 20 which also comprises a third conveyor constructed and arranged to advance along a path a continuous web of a plurality of battery plates, a cutter constructed and arranged to receive said web from said third conveyor and having at least one blade to sever individual battery plates from said web, said first conveyor receiving said individual battery plates, cutter drive means for rotating said cutter, synchronizing means operatively associated with said cutter drive means for controlling and adjusting the rotary speed and phase of said cutter relative to the lineal speed of said third conveyor to synchronize the blades of said cutter with the web, means for controlling and adjusting the lineal speed of said first and second conveyors relative to the lineal speed of said third conveyor, and another synchronizing means for varying and adjusting the phase of said second conveyor relative to said first conveyor.

45. The battery plate stacker of claim 27 which also comprises a third conveyor constructed and arranged to advance along a path a continuous web of a plurality of battery plates, a cutter constructed and arranged to receive said web from said third conveyor and having at least one blade to sever individual battery plates from said web, said first conveyor receiving said individual battery plates, cutter drive means for rotating said cutter, synchronizing means operatively associated with said cutter drive means for controlling and adjusting the rotary speed and phase of said cutter relative to the lineal speed of said third conveyor to synchronize the blades of said cutter with the web, means for controlling and adjusting the lineal speed of said first and second conveyors relative to the lineal speed of said third conveyor, and another synchronizing means for varying and adjusting the phase of said second conveyor relative to said first conveyor.

46. The battery plate stacker of claim 35 which also comprises a third conveyor constructed and arranged to advance along a path a continuous web of a plurality of battery plates, a cutter constructed and arranged to receive said web from said third conveyor and having at least one blade to sever individual battery plates from said web, said first conveyor receiving said individual battery plates, cutter drive means for rotating said cutter, synchronizing means operatively associated with said cutter drive means for controlling and adjusting the rotary speed and phase of said cutter relative to the lineal speed of said third conveyor to synchronize the blades of said cutter with the web, means for controlling and adjusting the lineal speed of said first and second conveyors relative to the lineal speed of said third conveyor, and another synchronizing means for varying and adjusting the phase of said second conveyor relative to said first conveyor.

* * * * *